US011319108B2

(12) United States Patent
Gauvin

(10) Patent No.: US 11,319,108 B2
(45) Date of Patent: May 3, 2022

(54) LOCKING PACKAGING

(71) Applicant: Diamond Packaging, Rochester, NY (US)

(72) Inventor: Andrew Gauvin, Pittsford, NY (US)

(73) Assignee: Diamond Packaging, Rochester, NY (US)

( * ) Notice: Subject to any disclaimer, the term of this patent is extended or adjusted under 35 U.S.C. 154(b) by 151 days.

(21) Appl. No.: 16/448,238

(22) Filed: Jun. 21, 2019

(65) Prior Publication Data

US 2020/0180808 A1 Jun. 11, 2020

Related U.S. Application Data

(60) Provisional application No. 62/776,712, filed on Dec. 7, 2018, provisional application No. 62/714,990, filed on Aug. 6, 2018.

(51) Int. Cl.
*B65D 5/38* (2006.01)

(52) U.S. Cl.
CPC ..... *B65D 5/38* (2013.01); *B65D 2215/02* (2013.01)

(58) Field of Classification Search
CPC ..... B65D 5/38; B65D 77/0433; B65D 59/04; B65D 83/063; B65D 2215/02–08
USPC ..... 206/1.5, 443, 363, 364, 530, 528; 229/125.125
See application file for complete search history.

(56) References Cited

U.S. PATENT DOCUMENTS 1,253,489 A 1/1918 Houghland
2,426,911 A * 9/1947 Williamson ..... B65D 5/38 229/122
3,302,844 A * 2/1967 James ..... B65D 5/38 229/120.18
5,275,291 A 1/1994 Sledge
6,230,893 B1 5/2001 Karow
6,491,211 B1 12/2002 Evans et al.
8,869,984 B2 * 10/2014 Bellamah ..... B65D 5/38 206/468
10,479,581 B2 * 11/2019 Chambers ..... B65D 5/0254
10,618,683 B2 * 4/2020 Jones ..... A61J 1/16
2005/0241966 A1 * 11/2005 Giannini ..... B65D 5/38 206/242
2007/0251983 A1 * 11/2007 Freeze ..... B65D 5/38 229/125.125
2008/0135606 A1 6/2008 Weston et al.
2011/0163156 A1 * 7/2011 Smith ..... B65D 83/0463 229/125.125
2019/0233158 A1 * 8/2019 Jones ..... B65D 75/367

OTHER PUBLICATIONS

International Search Report and Written Opinion dated Sep. 11, 2019 for International Application No. PCT/US19/38445; 8 pages.

* cited by examiner

*Primary Examiner* — Chun Hoi Cheung

(74) *Attorney, Agent, or Firm* — Bond Schoeneck & King, PLLC; Joseph M. Noto

(57) ABSTRACT

A locking package and method includes a tray insert having at least one locking tab of a folded over portion of a panel or wall of the insert and an outer sleeve having a dual panel or wall having an inner panel or wall with at least one locking notch and an outer panel or wall with at least one locking tab release, wherein when the insert is fully slid into the sleeve the at least one locking tab, at least one locking notch and at least one locking tab release are positioned to lock and unlock the package.

11 Claims, 27 Drawing Sheets

LOCKING PACKAGING

CROSS REFERENCE

This application claims the benefit of the filing date of U.S. Provisional Patent Application Ser. No. 62/714,990, filed Aug. 6, 2018, and U.S. Provisional Patent Application Ser. No. 62/776,712, filed Dec. 7, 2018, which are hereby incorporated by reference in its entirety.

FIELD

The present disclosure relates generally to a locking carton, and in particular to a locking carton having an insert with a locking tab of a folded over portion and an outer sleeve having a dual component locking notch/tab release corresponding to the locking tab; and related methods.

BACKGROUND

In the field of locking packaging for a wide range of consumer goods, it is desired to provide consumers with secure packaging, particularly healthcare and medication packaging, having features to restrict or prevent access to the contents by a certain group of individuals while at the same time providing access with some degree of ease by another group of individuals.

SUMMARY

In accordance with one aspect of the present disclosure, there is provided a locking package including:

a tray insert including top panel, bottom panel, front wall, back wall and two side walls, wherein at least one locking tab is composed of a folded over portion of a panel or wall of the insert; and an outer sleeve including top panel, bottom panel, back wall, an opening opposite the back wall and two side walls, wherein at least one panel or side wall has a dual panel or wall, respectively, wherein the dual panel or wall includes an inner panel or wall including at least one locking notch and an outer panel or wall including at least one locking tab release, wherein when the insert is fully slid into the sleeve the at least one locking tab, at least one locking notch and at least one locking tab release are positioned to lock and unlock the package.

In accordance with another aspect of the present disclosure, there is provided a locking package including:

a tray insert including top panel, bottom panel, front wall, back wall and two side walls, wherein at least one locking tab and a prevention tab at one end of the tray are each composed of a folded over portion of panel or wall of the insert; and an outer sleeve including top panel, bottom panel, two side walls and an opening at each end, wherein at least one panel or wall includes an inner panel or wall including at least one locking notch and a prevention notch at one open end of the sleeve and an outer panel or wall including at least one locking tab release, wherein when the insert is fully slid into the sleeve the at least one locking tab, at least one locking notch and at least one locking tab release are positioned to lock and unlock the package, and wherein the prevention tab and prevention notch cooperate at the one open end of the sleeve preventing the sleeve from being pulled out from the other open end of the sleeve.

In accordance with another aspect of the present disclosure, there is provided a method for unlocking a package including:

unlocking a package insert from a package sleeve by applying pressure to two or more release points of the sleeve to release two or more corresponding locking tabs of the insert from two or more corresponding locking notches of the sleeve, with one hand, and simultaneously gripping and pulling at an access point of the insert with the opposite hand, and optionally re-locking the package by sliding the insert into the sleeve, inserting the two or more corresponding locking tabs of the insert into the two or more corresponding locking notches of the sleeve and continue sliding until a clicking sound is created.

These and other aspects of the present disclosure will become apparent upon a review of the following detailed description and the claims appended thereto.

Figure 15A:
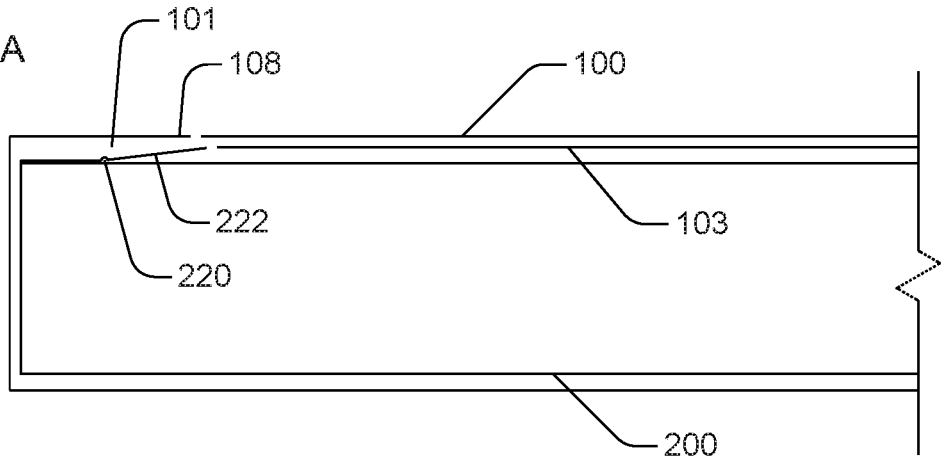
Figure 15B:
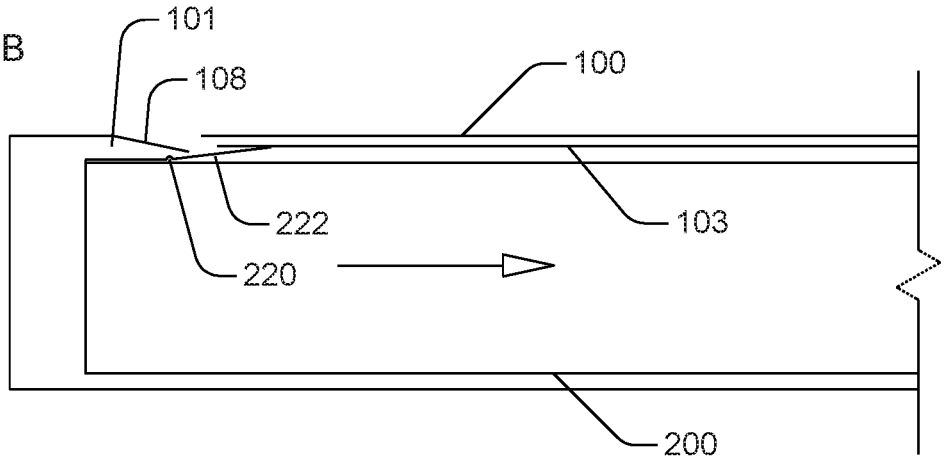
Figure 16A:
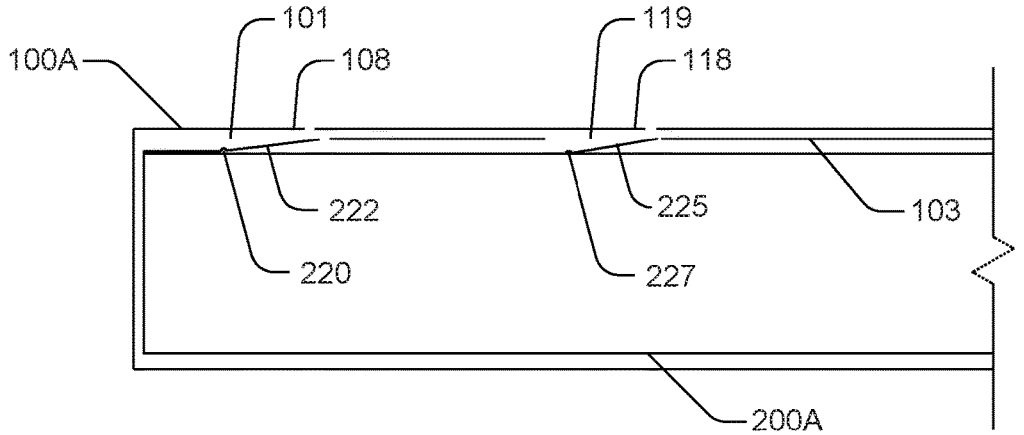
Figure 16B:
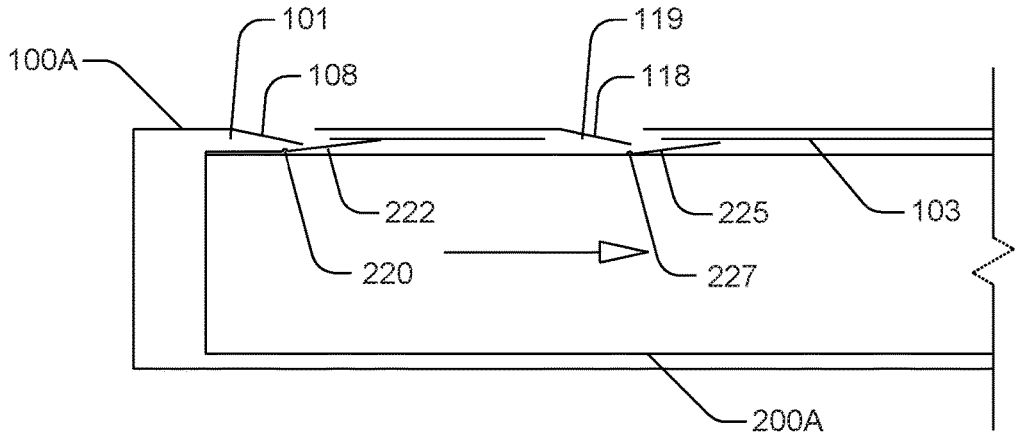
Figure 17:
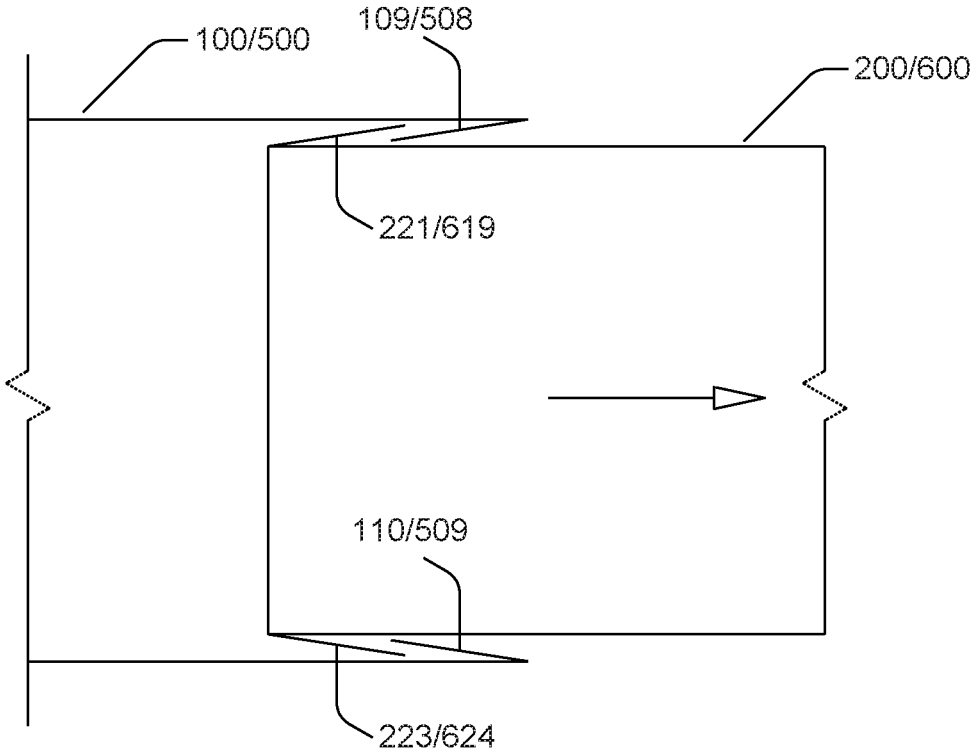
Figure 18:
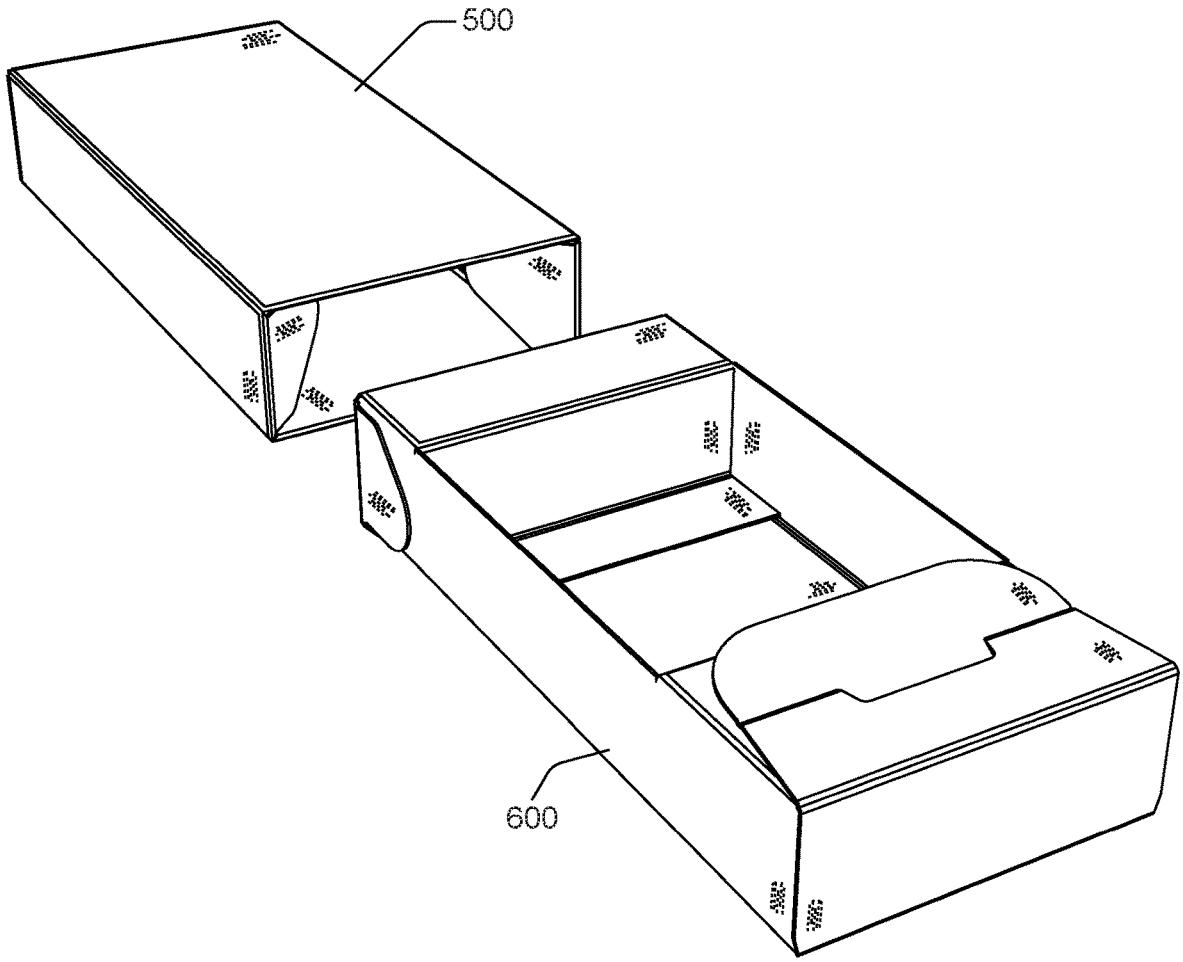
Figure 19:
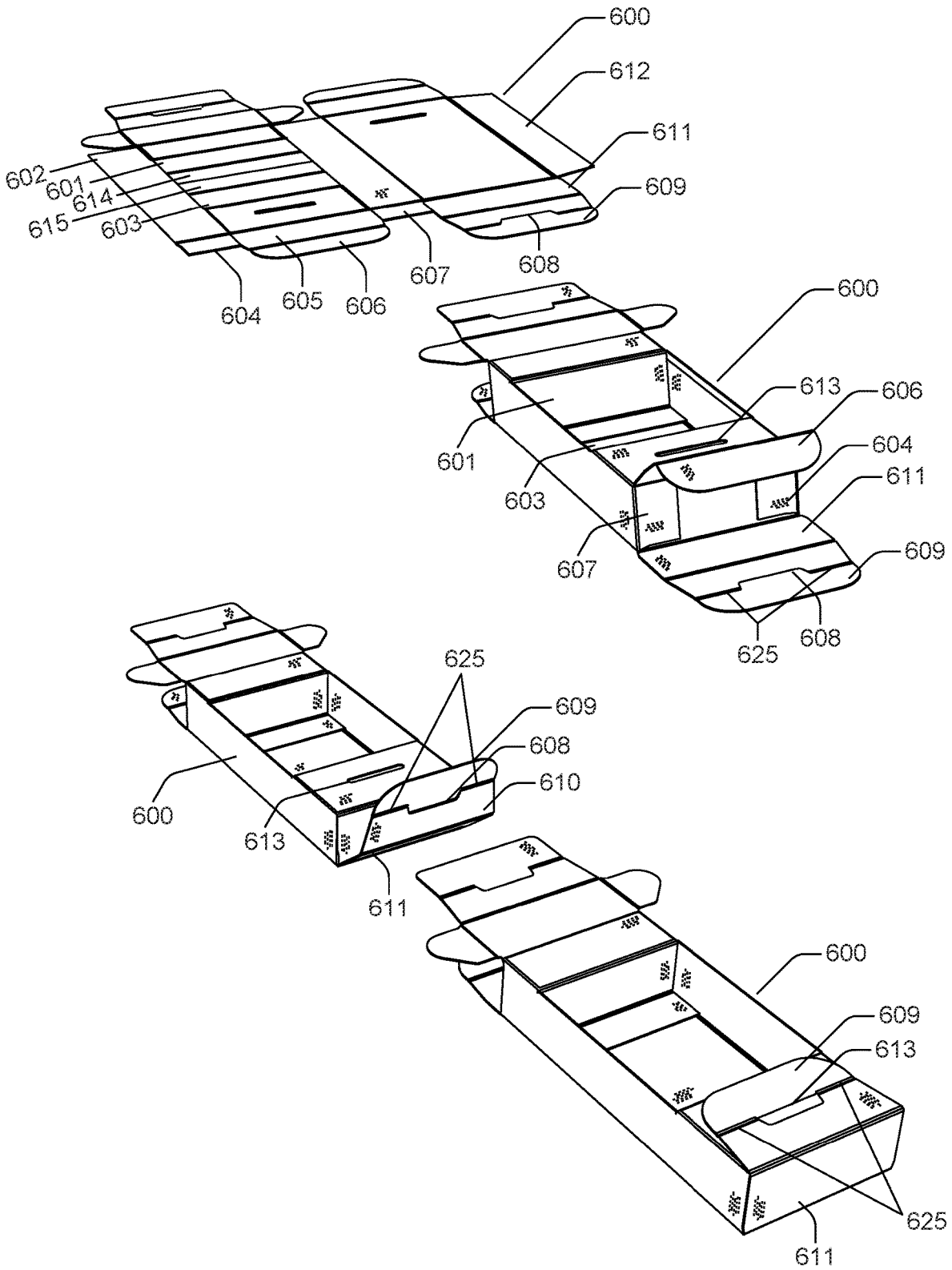
Figure 20:
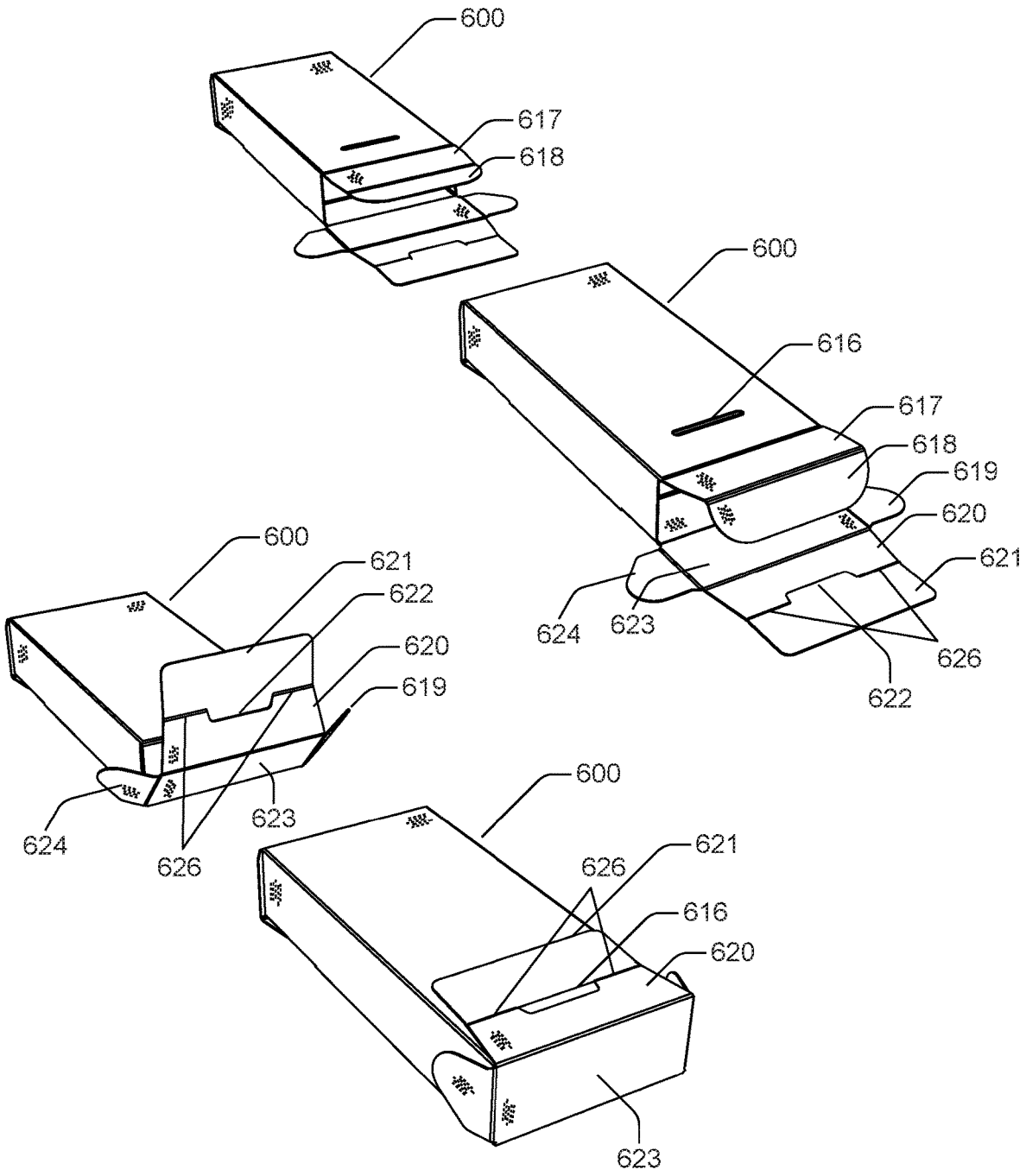
Figure 21:
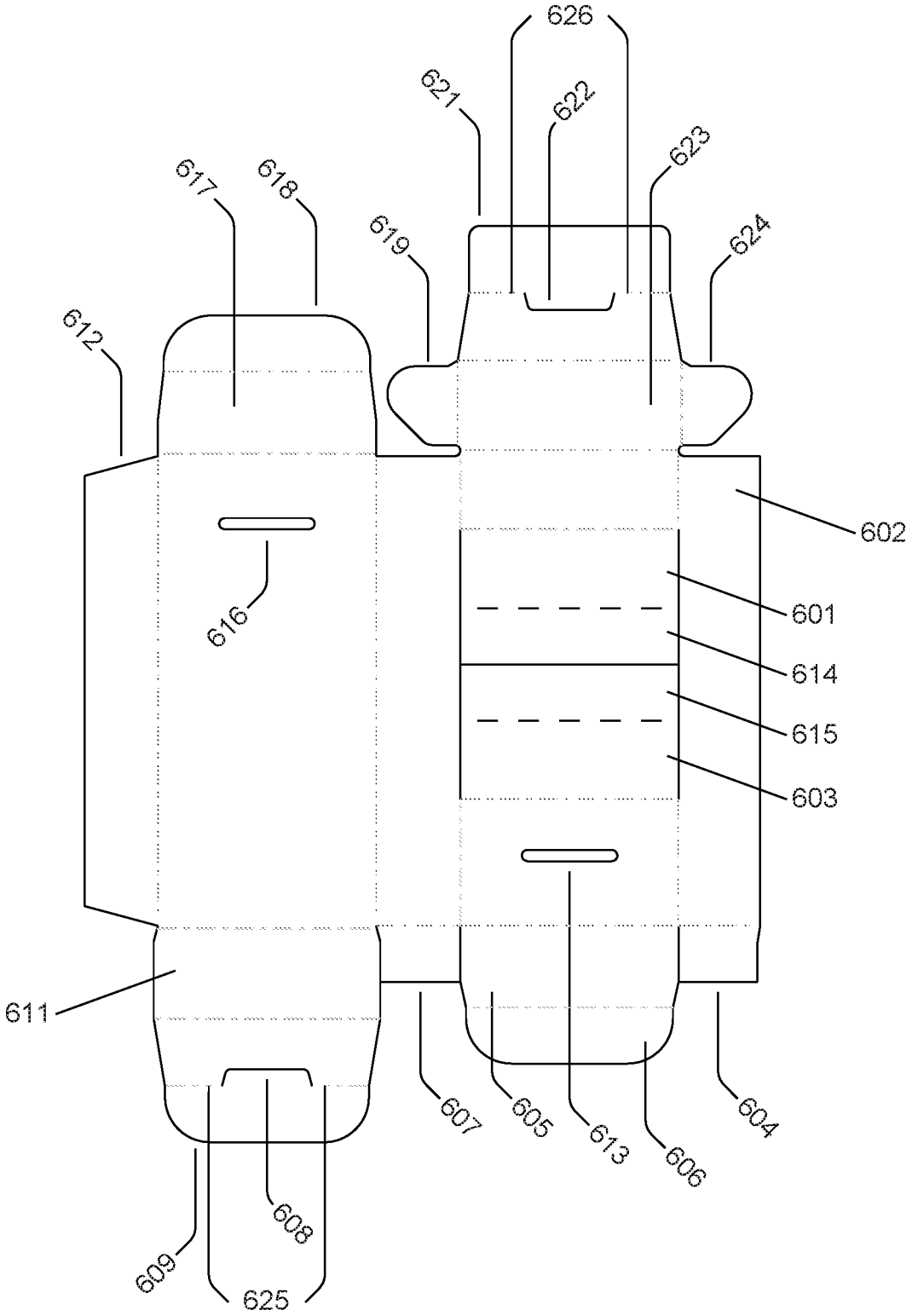
Figure 22:
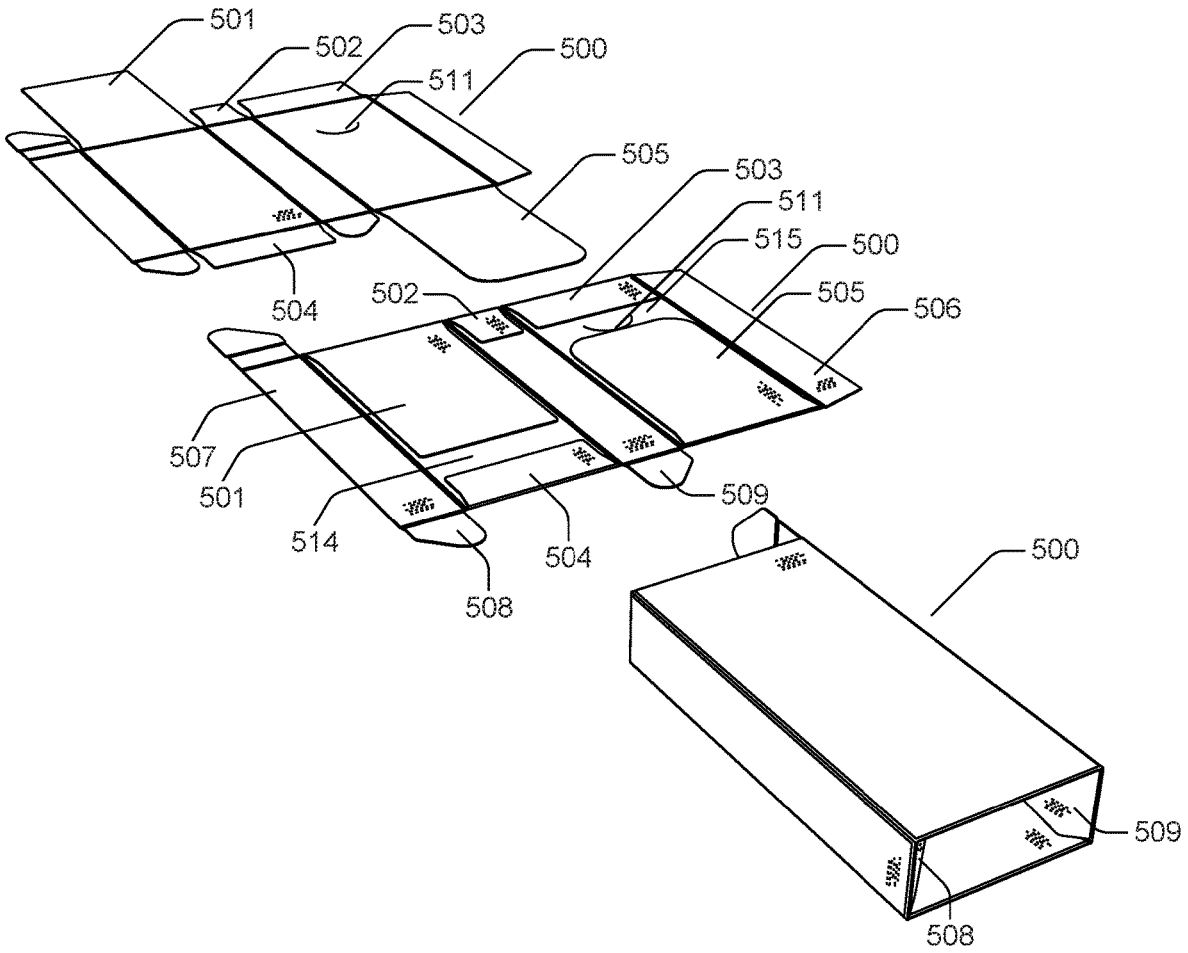
Figure 23:
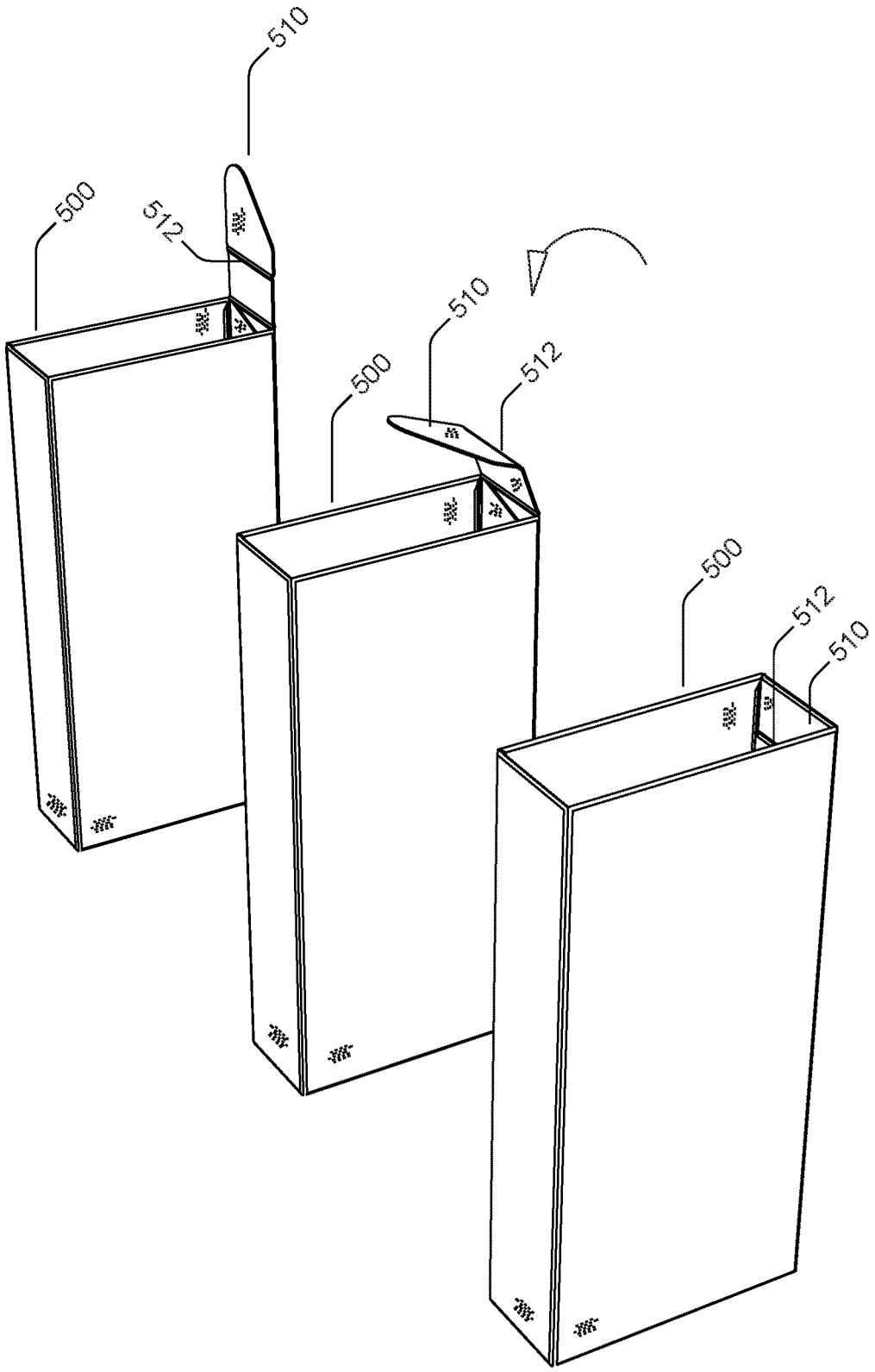
Figure 24:
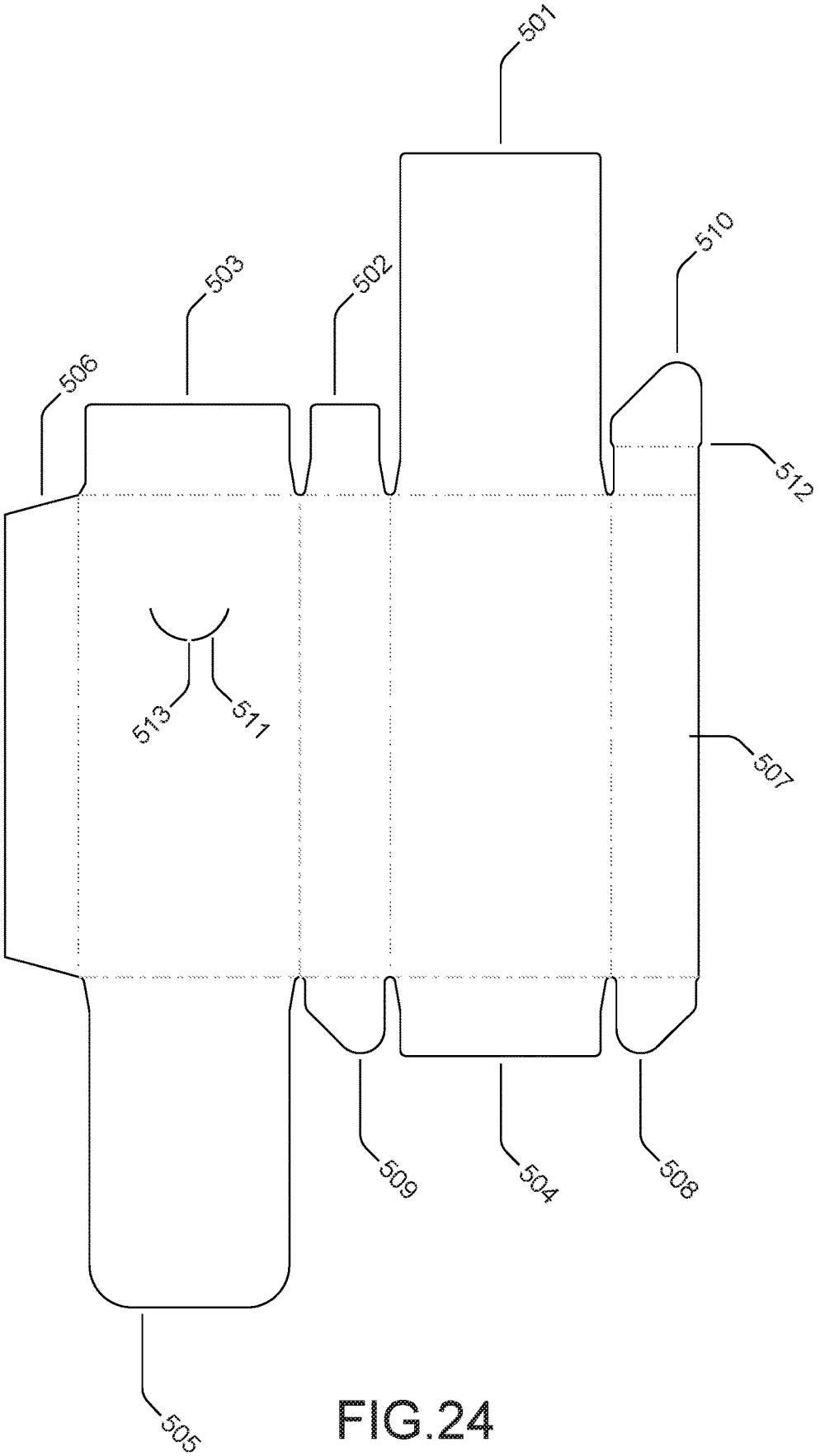
Figure 25A:
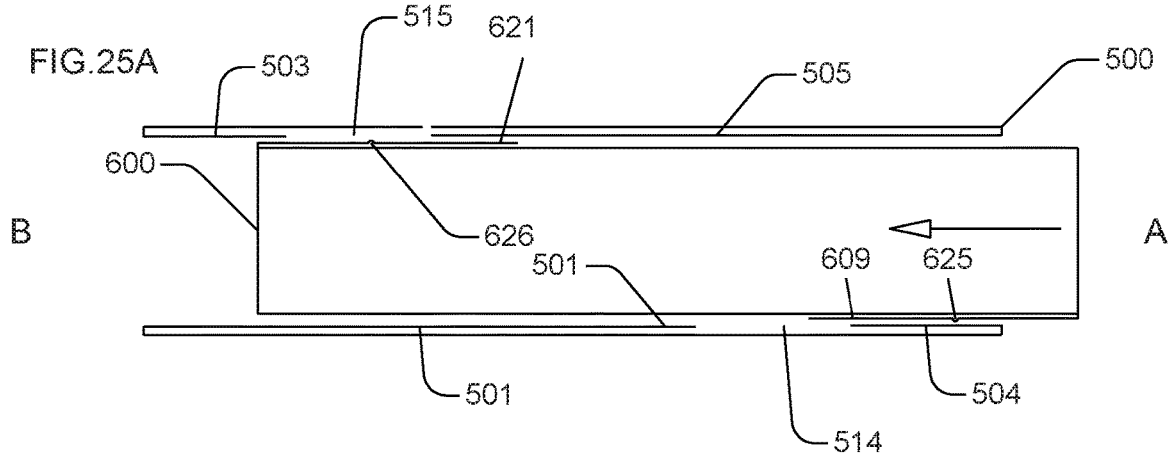
Figure 25B:
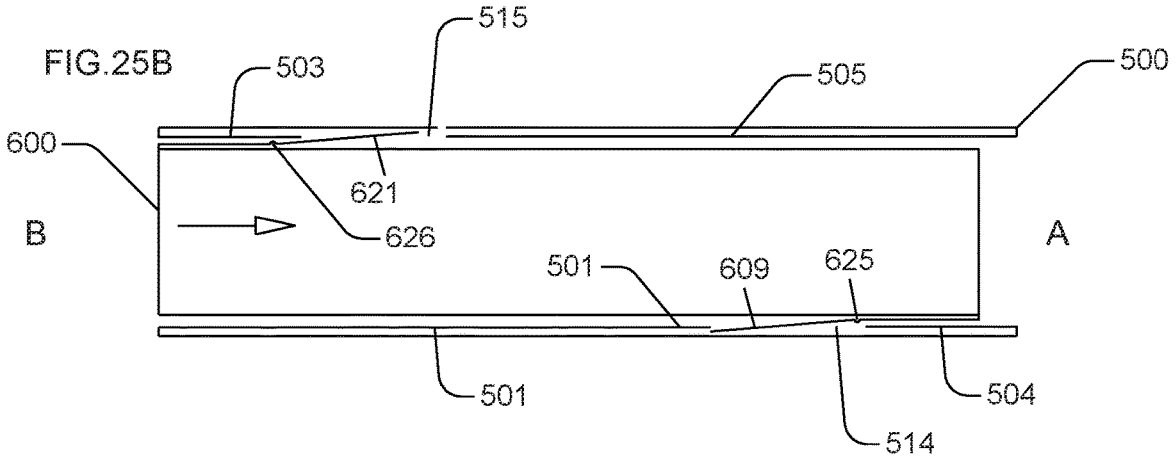
Figure 25C:
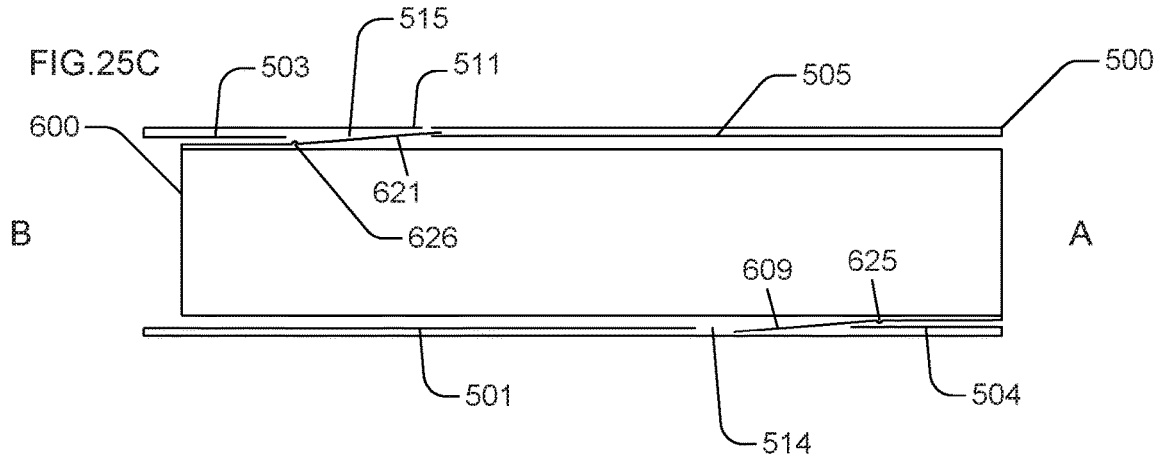
Figure 26A:
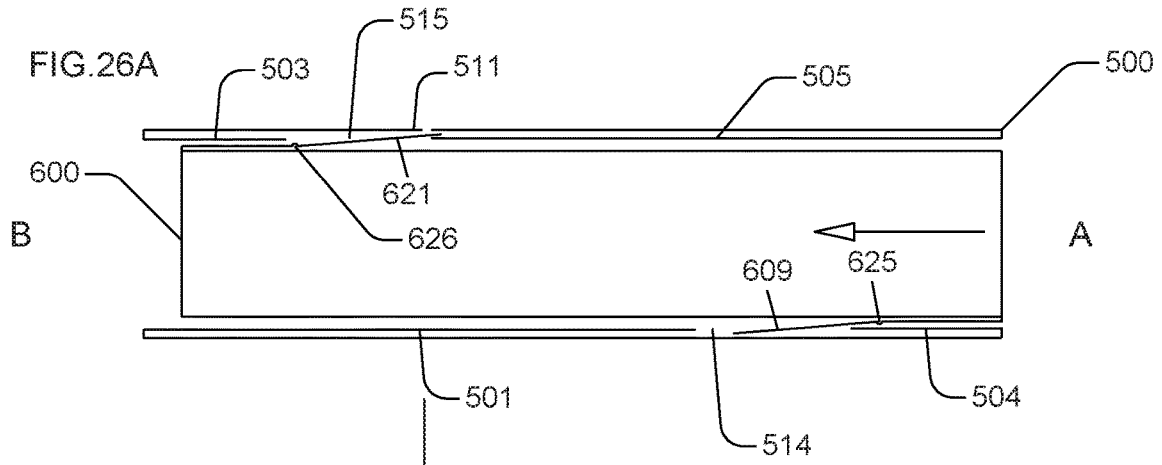
Figure 26B:
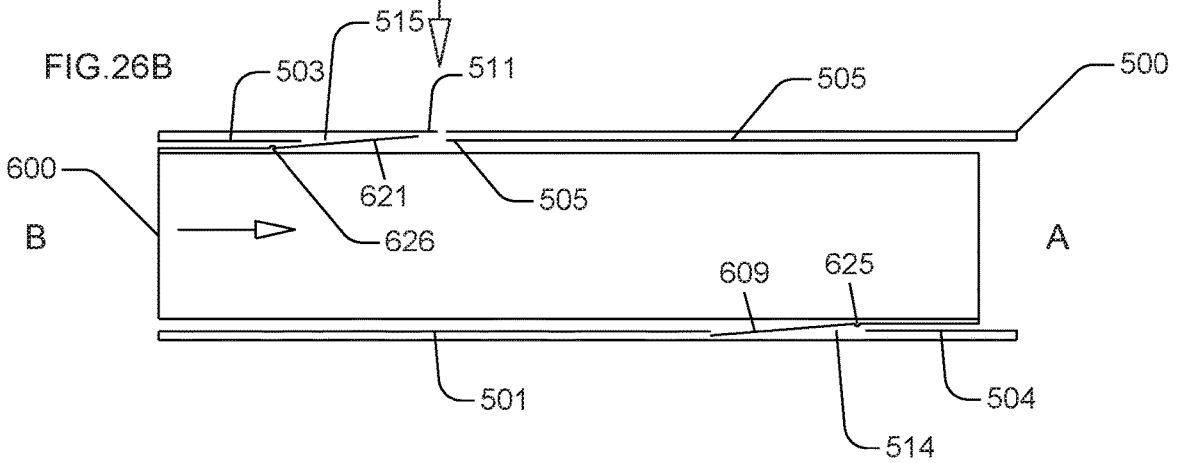
Figure 26C:
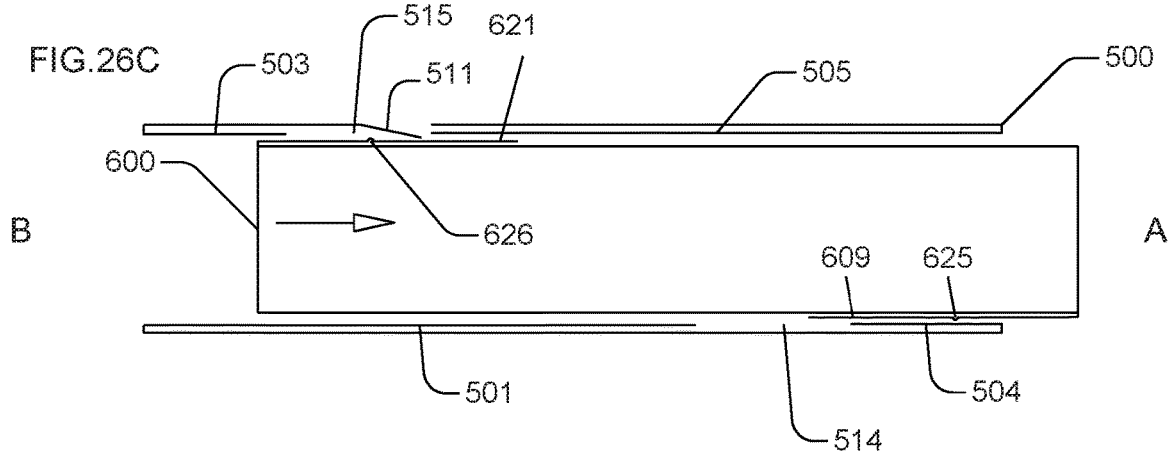
Figure 27A:
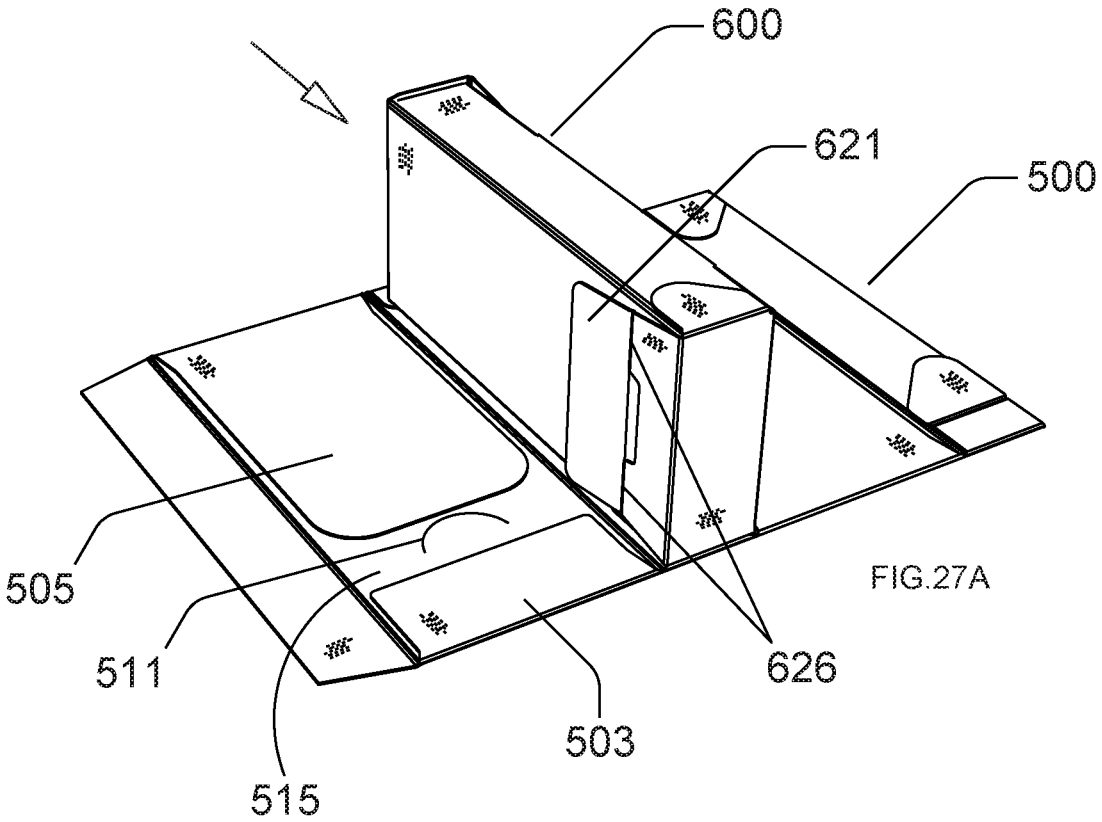
Figure 27B:
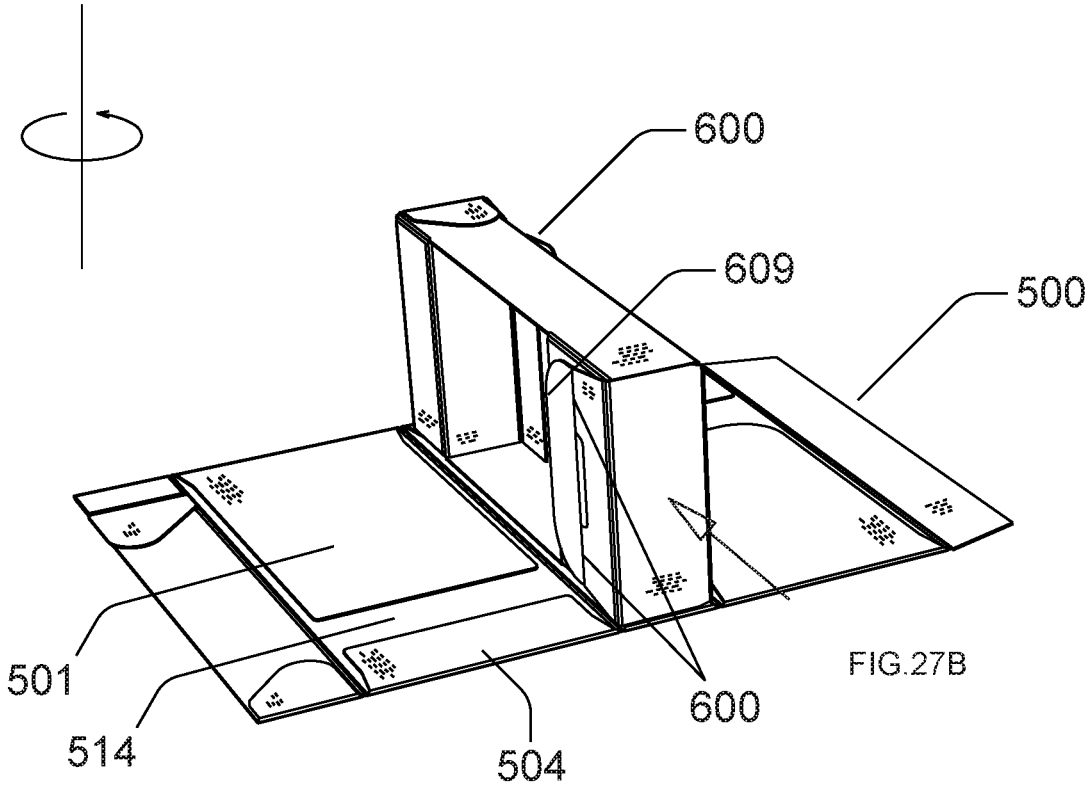

14A) with the prevention tab engaging the prevention notch (FIG. 14B) in accordance with an embodiment;

FIGS. 15A-B illustrate partial side views of a cross-section of an assembled insert inside an assembled sleeve in a locked (FIG. 15A) and unlocked (FIG. 15B) position with one locking tab in accordance with an embodiment;

FIGS. 16A-B illustrate partial side views of a cross-section of an assembled insert inside an assembled sleeve in a locked (FIG. 16A) and unlocked (FIG. 16B) position with two locking tabs in accordance with an embodiment;

FIG. 17 illustrates a partial top view of an assembled insert in a halted open position in the assembled sleeve in accordance with an embodiment;

FIG. 18 illustrates a top perspective view of an assembled insert and a sleeve in accordance with an embodiment;

FIG. 19 illustrates a top perspective view of a series in progression of an insert shown unglued and partially assembled in accordance with an embodiment;

FIG. 20 illustrates a bottom perspective view of a series in progression of a sleeve insert shown partially assembled and fully assembled in accordance with an embodiment;

FIG. 21 illustrates an unglued view of an insert in accordance with an embodiment;

FIG. 22 illustrates a top perspective view of a series in progression of a sleeve shown unglued and partially assembled in accordance with an embodiment;

FIG. 23 illustrates a front perspective view of a series in progression of a sleeve shown partially assembled and fully assembled in accordance with an embodiment;

FIG. 24 illustrates an unglued view of the open-ended sleeve in accordance with an embodiment;

FIG. 25A-C illustrate partial side views of a cross-section of a series in progression of an assembled insert inserting (FIG. 25A) and locking (FIGS. 25B & 25C) in an assembled open-ended sleeve in accordance with an embodiment;

FIG. 26A-C illustrate partial side views of a cross-section of a series in progression of an assembled insert locked (FIG. 26A) and unlocking (FIGS. 26B & 26C) in an assembled sleeve in accordance with an embodiment; and FIGS. 27A-B illustrate a flat open perspective view of the unassembled sleeve and a side perspective view of an assembled insert (FIG. 27A) and a rotated 180-degree flat open perspective view of the unassembled open-ended sleeve and a side perspective view of an assembled insert (FIG. 27B) in accordance with an embodiment.

DETAILED DESCRIPTION

Figure 1:
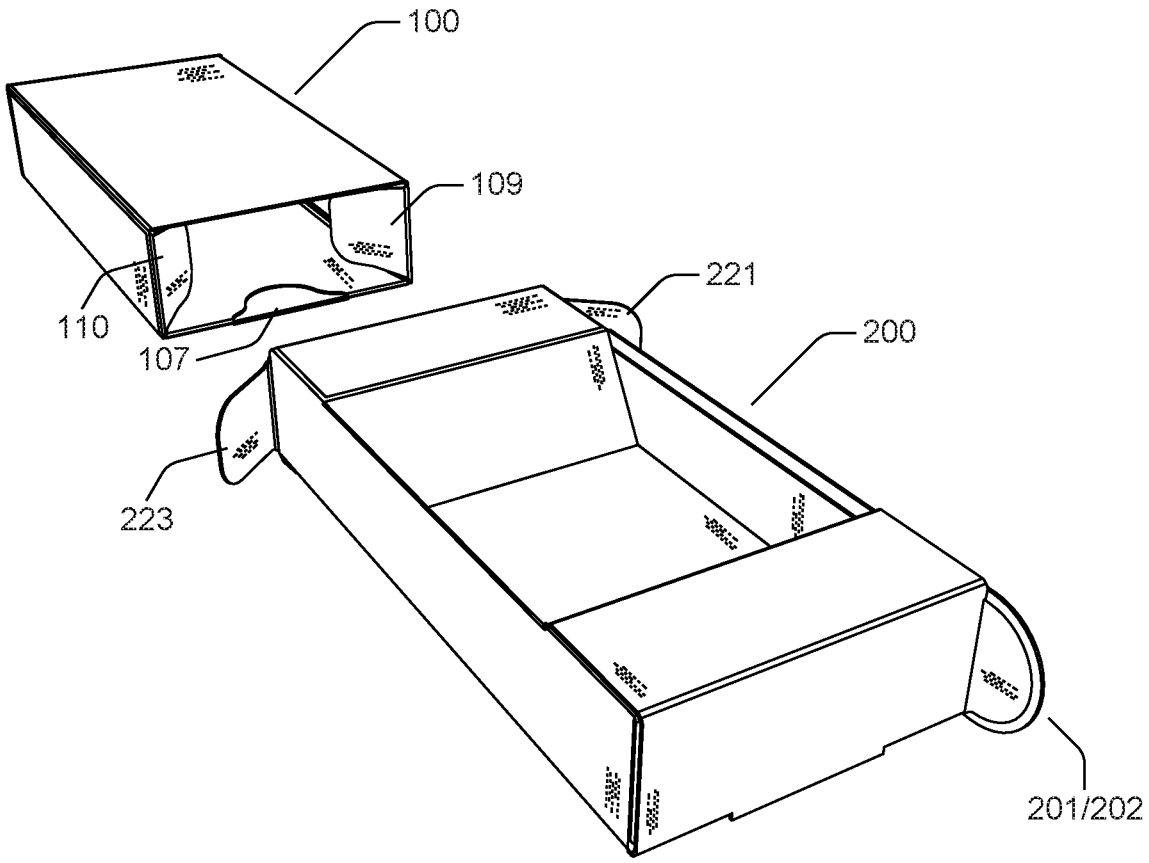
FIG. 1 illustrates a top perspective view of an assembled insert and sleeve in accordance with an embodiment.
Figure 2:
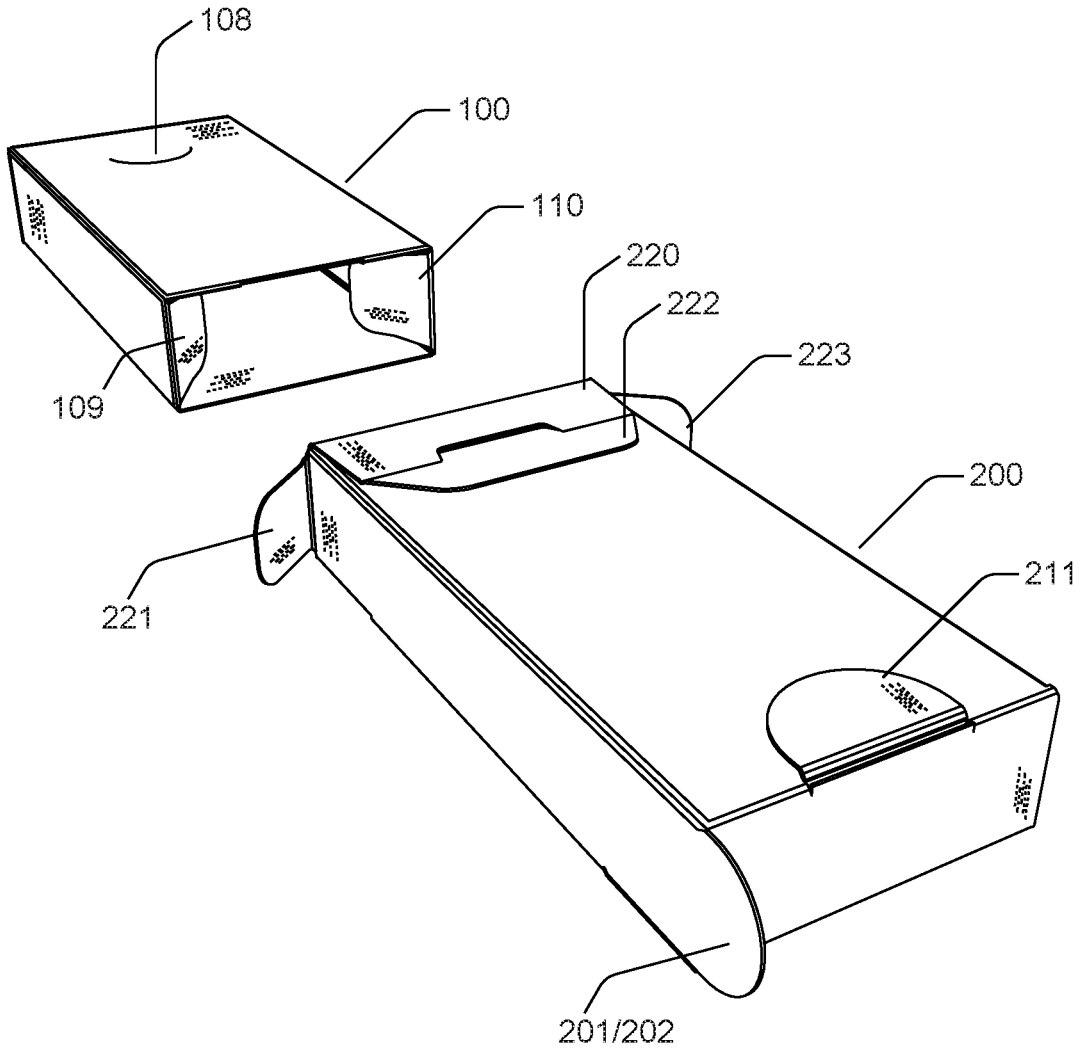
FIG. 2 illustrates a bottom perspective view of an assembled insert and sleeve with one locking feature in accordance with an embodiment.
Figure 3:
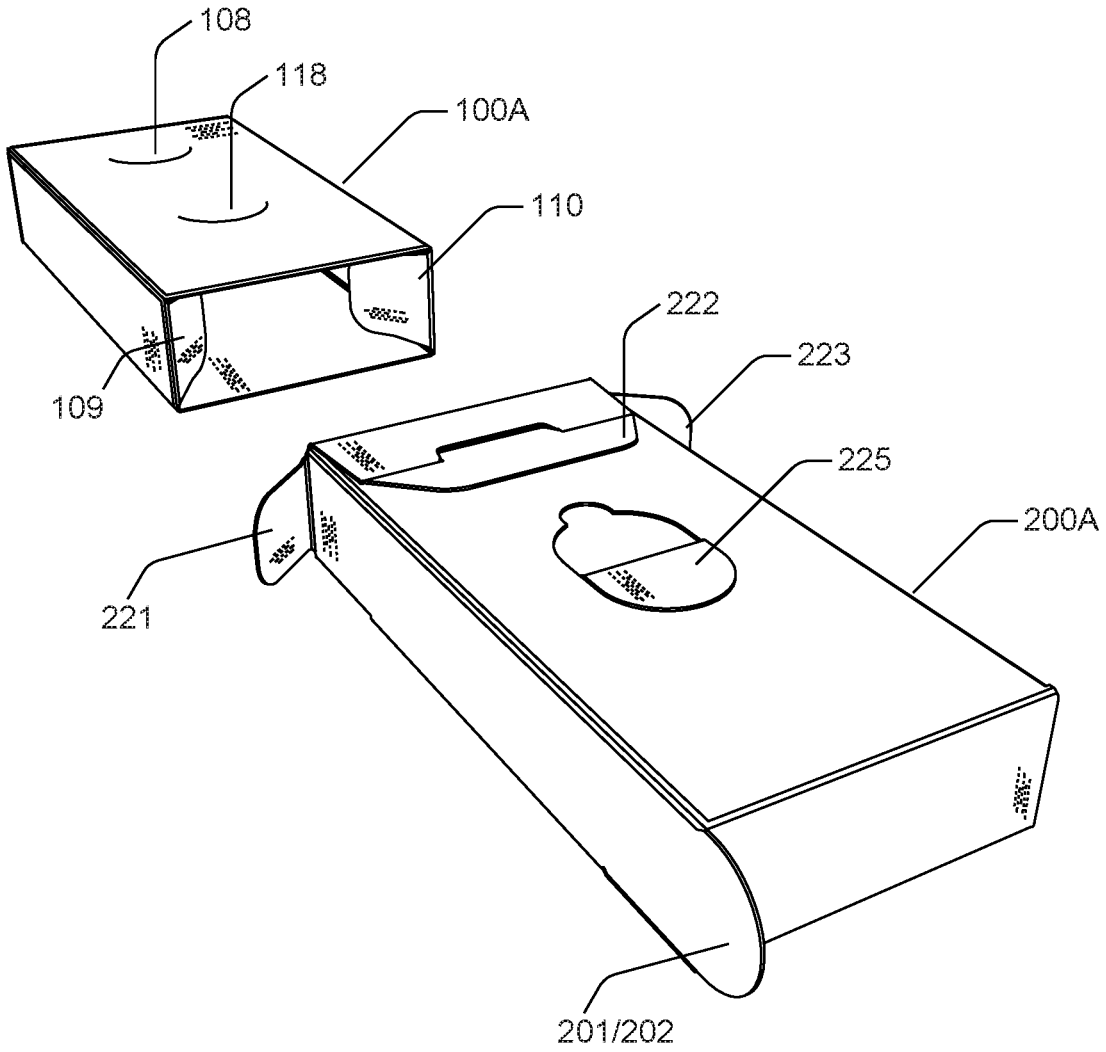
FIG. 3. illustrates a bottom perspective view of an assembled insert and sleeve with two locking features in accordance with an embodiment.
Figure 4:
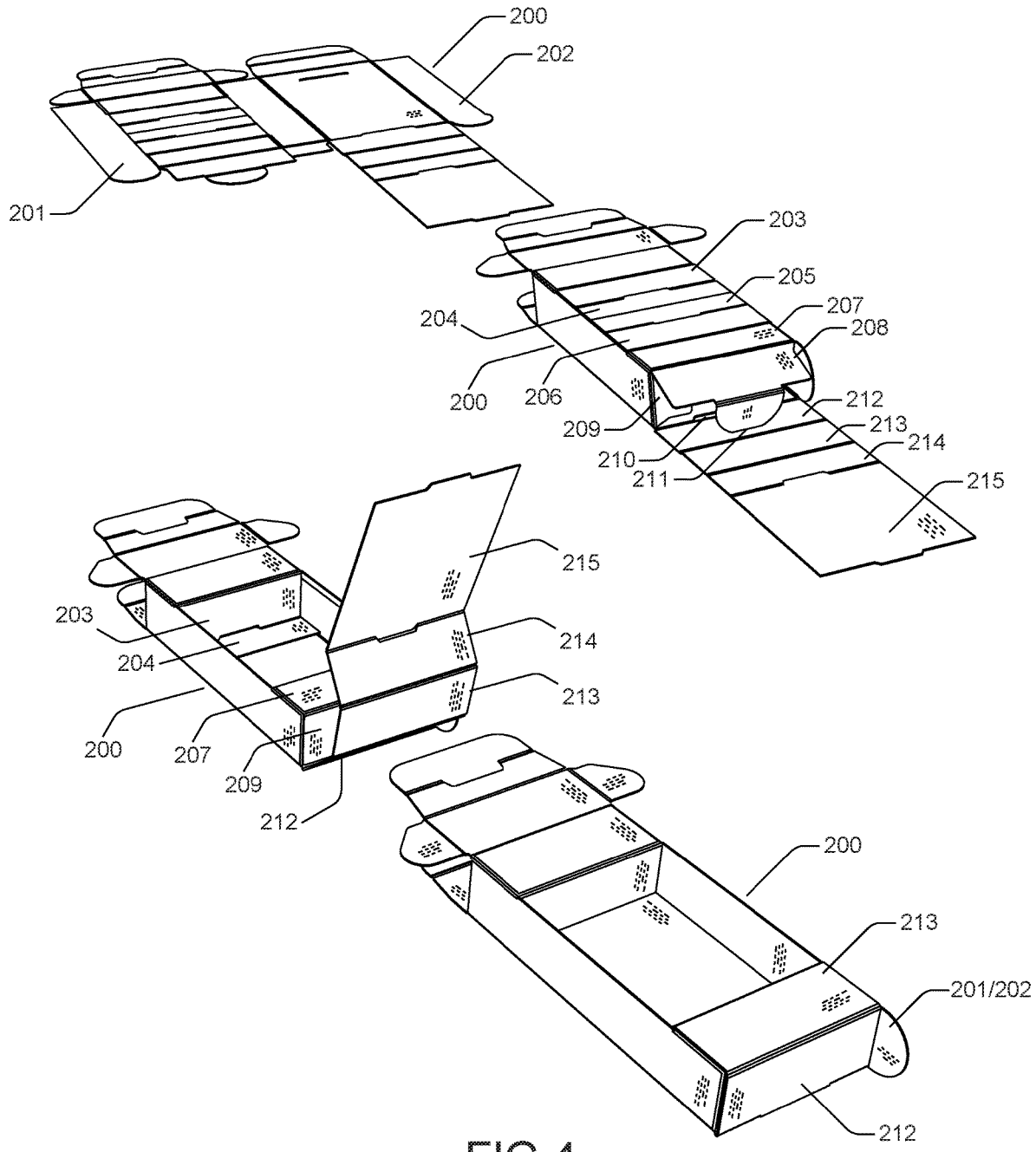
FIG. 4 illustrates a top perspective view of a series in progression of an insert with one locking tab shown unglued and partially assembled in accordance with an embodiment.
Figure 5:
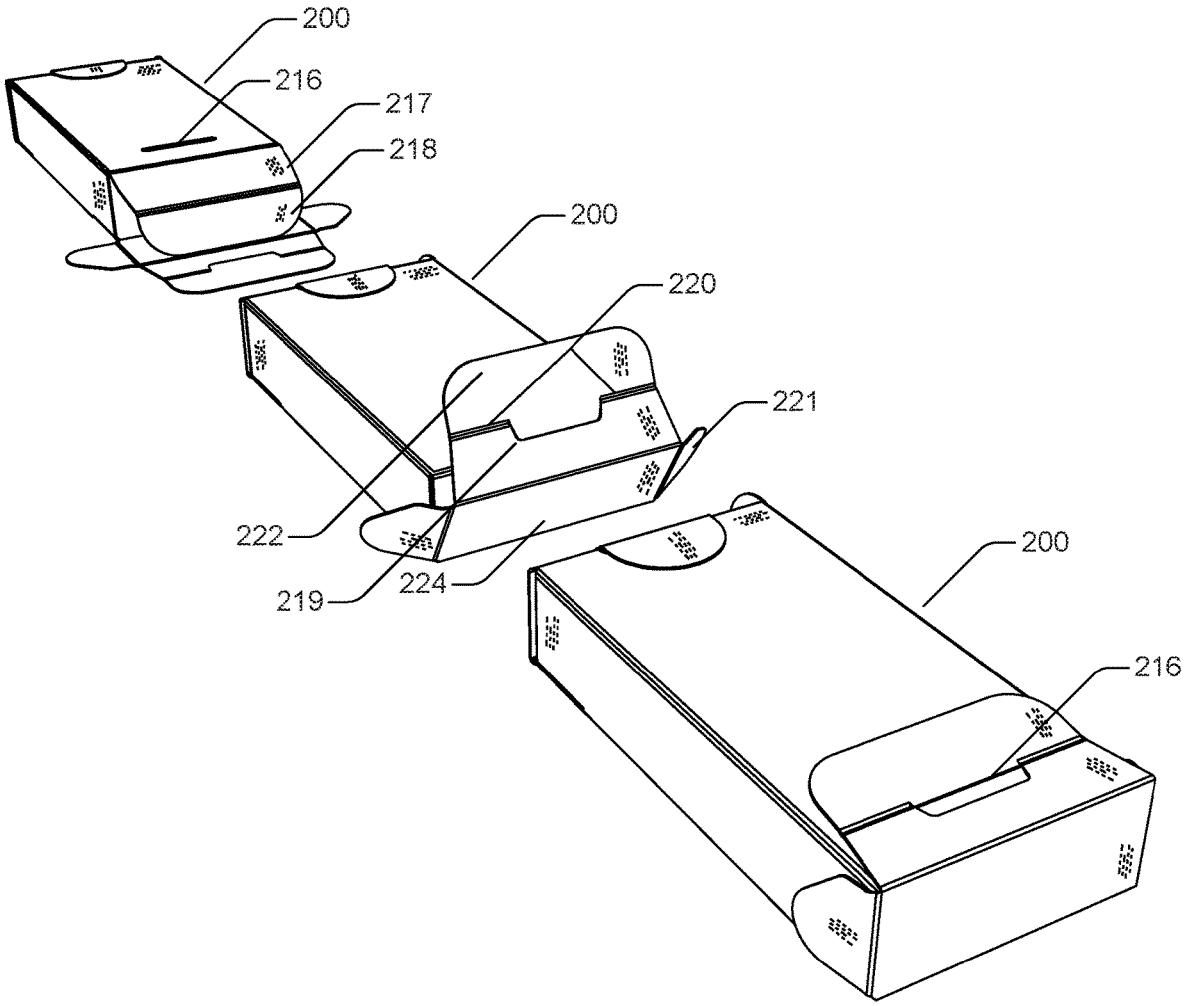
FIG. 5 illustrates a bottom perspective view of a series in progression of an insert with one locking tab shown partially assembled and fully assembled in accordance with an embodiment.

Referring to FIG. 1 an embodiment of a locking child resistant package is composed of two folding carton components, e.g., an insert 200 and a sleeve 100 that contain one or more locking features and preferably accessible to a person of the appropriate age. A locking feature is defined as having a locking tab 222 (shown in FIG. 2), a corresponding shaped locking notch 101 (the area shown in FIG. 7), and a release point 108 (shown in FIG. 2) that are strategically positioned to work together. FIG. 3 illustrates an insert 200A with two locking tabs 222, 225, a sleeve 100A with two corresponding shaped locking notches 101, 119 (visible from the inside, as shown in FIG. 13B) and two release points 108, 118.

A corresponding shape is any shape of the notch/slot and any shape of the tab that enables the notch/slot to catch or capture the locking tab when the package is in a closed position so as to lock in accordance with the present disclosure. Optionally, the release point has a shape similar to that of the locking notch. Locking tabs are created by extending material from the minor or major panels of the sleeve and/or insert. Notches and slots can be formed by die cutting shapes out of the material that leave a void. Notches can also be formed by folding and gluing panels over thus creating cavities. The illustrated and described features below depict an insert and a variety of outer sleeves with varying end closures. These combinations of components will work in a variety of paperboard and plastic materials.

Figure 13A:
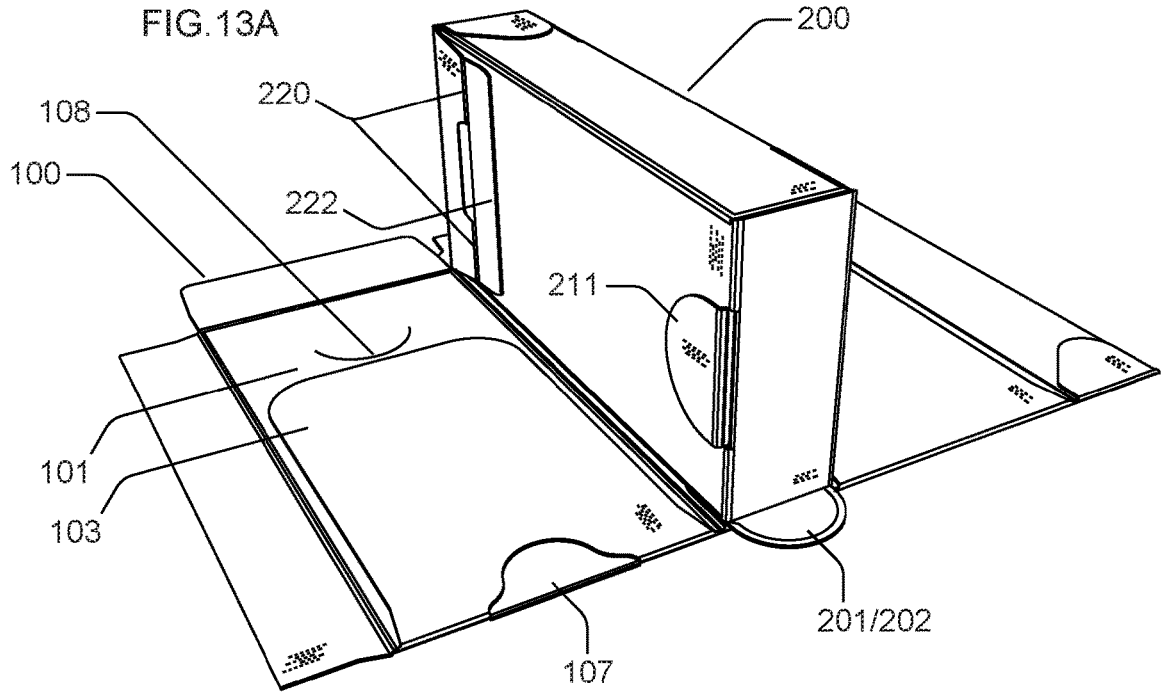
FIGS. 13A-B illustrate a flat open perspective view of the unassembled reinforced sealed end sleeve and a side perspective view of an assembled insert with one locking feature (FIG. 13A) and two locking features (FIG. 13B) in accordance with an embodiment.
Figure 13B:
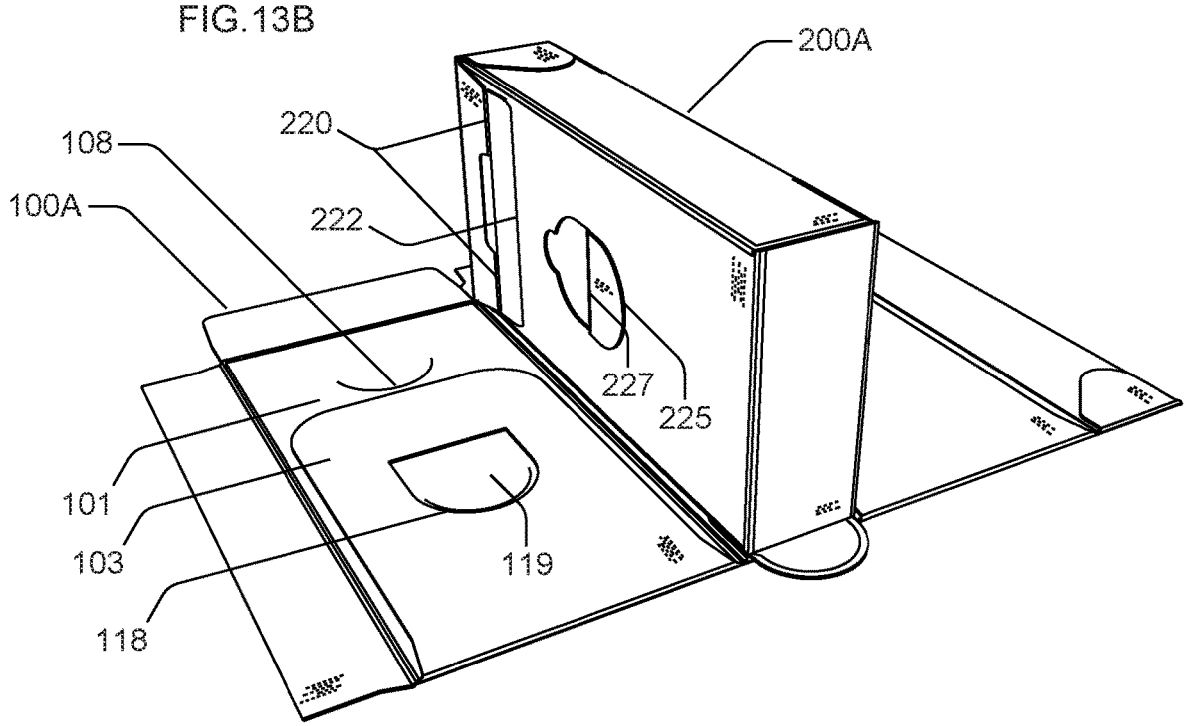

In an embodiment, the insert contains the locking tab 222 (FIGS. 2, 3, 4, 5, 6 and 13A). The sleeve contains the locking notch 101 (visible from inside or open views) and the release point 108 both shown in (FIGS. 2, 3, 7, 8, 9, 10 and 13A). FIG. 13A illustrates a perspective view of an opened partially glued sleeve 100 with an assembled insert 200 that depicts the relationship between the locking tab 222, locking notch 101 and release point 108. As the insert 200 slides into the sleeve 100, the locking tab 222 slides over the edge of back-reinforced panel 103 of the sleeve 100 and into the locking notch 101 creating a clicking sound. This ensures that the package is properly locked in child resistant mode. Additional locking features may be added when needed. FIGS. 3, 6B, and 13B illustrate an additional locking tab 225 formed by folding back material on the outer side of the insert 200A. A corresponding shaped notch is visible in FIGS. 9B and 13B and created on the back-reinforcing panel 103 of the sleeve 100A. The matching release point 118 is shown in FIGS. 3, 9B and 13B.

Figure 14A:
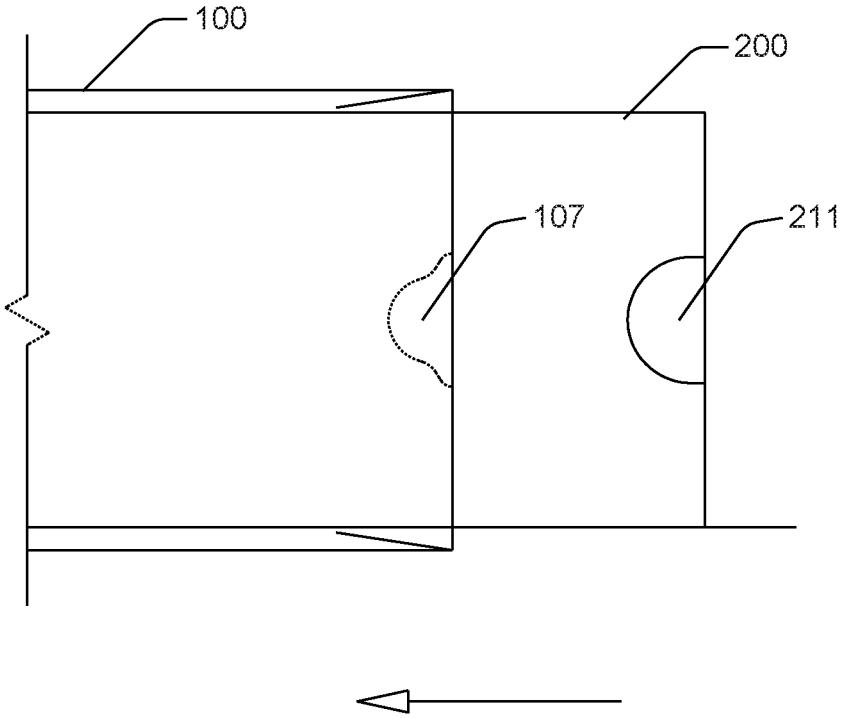
FIGS. 14A-B illustrate partial bottom views of an assembled insert sliding into an assembled sleeve (FIG.
Figure 14B:
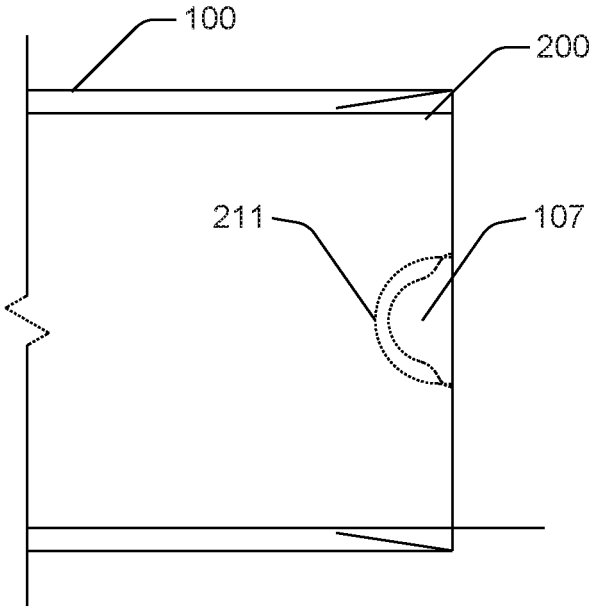

Optionally, a prevention tab 211 present on the back of insert 200 as shown in FIGS. 2, 4, 6A and 13A, can be created by extending material from a major panel 208 of the insert 200. A corresponding prevention notch 107 is formed from a void on the back-reinforcing panel 103 and will be present on the inside of the sleeve 100, as shown in FIGS. 1, 7, 9A, 10, and 13A. The prevention tab 211 is simultaneously inserted into the prevention notch 107 as depicted in FIGS. 14A-B. This tab prevents the insert from sliding out the opposite end of the sleeve in the event the closed end of the sleeve is structurally compromised. Insert 200A is shown without a prevention tab. The tab is replaced with a standard tuck 226 depicted in FIGS. 3, and 6B. The corresponding slot would then also be removed as shown in FIG. 9B.

Figure 6A:
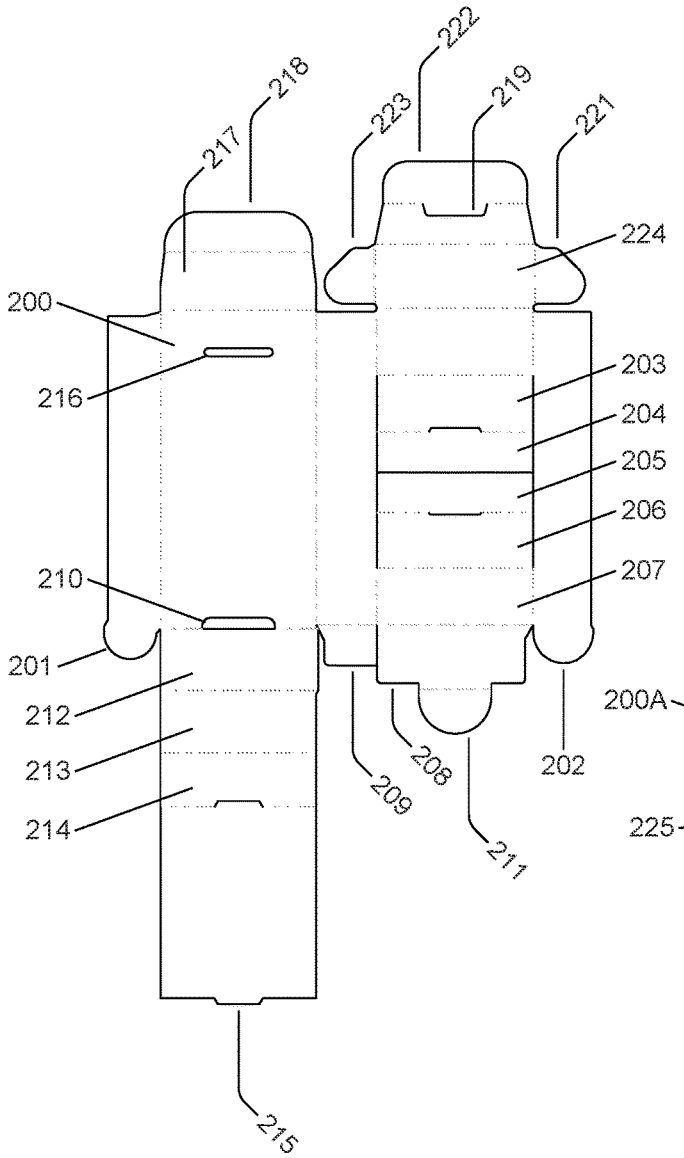
FIGS. 6A-B illustrate an unglued view of the insert with one locking tab (FIG. 6A) and with two locking tabs (FIG. 6B) in accordance with embodiments.
Figure 6B:
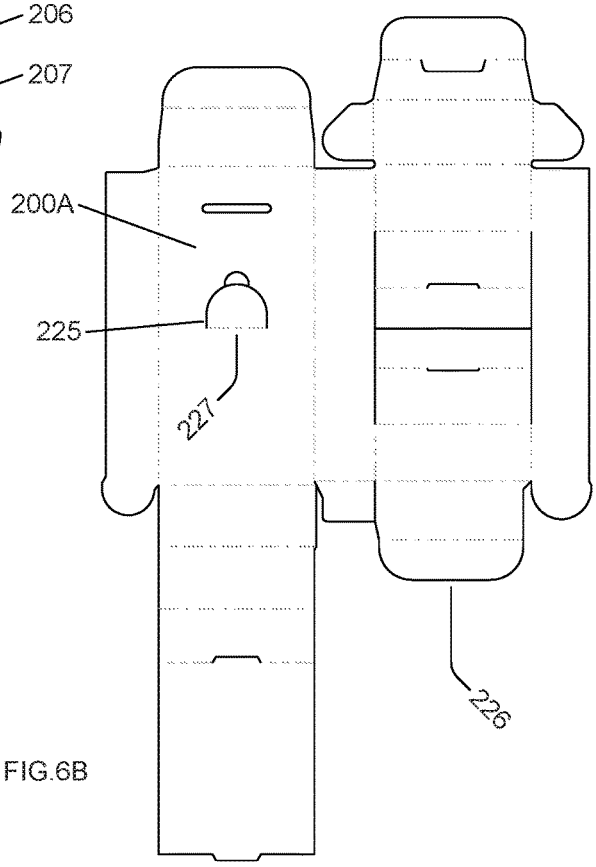

To unlock, first locate the locking tab release point 108 on the sleeve 100 (shown in FIGS. 2, 7, 8, 9, and 10). Apply pressure to the release point 108 of the sleeve breaking the nick 115 (a nick is a skip or void in the cutting rule of the cutting die as shown in FIG. 9A). Continue applying pressure to the release point while simultaneously gripping and pulling the access point 201/202 of the insert, shown in FIG. 1, with the opposite hand. Pressing in the release point 108, forces the locking tab 222 to lay flat against the insert 200 allowing it to avoid the locking notch 103 and the edge of the back-reinforcing panel of the sleeve 100 as shown in FIGS. 15A-B. Optionally, the insert can be gripped at a portion exposed by a corresponding void at the sleeve end (not shown). In an embodiment having two or more locking features, the release points are pressed simultaneously applying pressure with one hand, and simultaneously gripping and pulling at the access points of the insert with the opposite hand. FIGS. 16A-B show a sleeve 100A having two release points 108, 118, two locking notches 101, 119 and two corresponding locking tabs 222, 225 on the insert 200A. The insert will unlock, as shown in FIGS. 15B and 16B, and slide into a halted position as shown in FIG. 17. The latching locking tabs 221, 223 on the insert and corresponding latching locking tabs 109, 110 on the sleeve prevent the insert from sliding completely out of the sleeve. The latching locking tabs 109, 110 on the sleeve 100 can be created by folding extended material from the side panel (FIG. 9A). The latching locking tabs 221, 223 on the insert 200 can be formed by folding extended material from the top panel of the insert (FIG. 6A). The nick(s) 115, 116 can also be used as a tamper-evident indicator, if broken prior to consumer use.

To re-lock the package, slide the insert back into the sleeve, ensuring that the prevention tab 211 (if present) inserts correctly in the prevention notch 107 of the sleeve, as shown in FIGS. 14A-B. Continue sliding until a clicking sound is created re-engaging the locking tab(s) 222, 225 with the locking notch(es) 103, 119 as shown in FIGS. 15A and 16A. The package is now returned to child-resistant mode.

FIGS. 4-6A illustrate perspective and flat views of an insert 200 with one locking tab 222. The insert 200 can be conventionally folded and glued on standard gluing equipment and contains a full glue flap 202 that adheres to the opposite side panel 201. Extending from the side panel is an end tab 201 (also known as an access point), that when adhered to the glue flap 202, is doubled in thickness and strengthened. The insert 200 is then manually assembled. After the insert is assembled, the minor flap 209 opposite the pull tab is folded followed by the top major panel 208. As the top major panel is folded, the prevention tab 211 is inserted into the prevention tab slot 210. The product cavity is then formed by pressing down on the cavity panels 203, 206. As these panels fold down, the cavity feet 204, 205 fold-up. A reinforced cavity is formed by folding the bottom panels 212, 213 over the top major panel 208 and the lower front panel 207. The reinforced cavity panel 214 folds over the cavity panel 206 and the cavity floor panel 215 locks into the cavity feet 204, 205. On the backside of the insert 200 (FIG. 5) the bottom major panel 217 and tuck 218 are folded inside and the top major panel 224 is folded on top. The locking tab 222 is slightly folded up on the score 220 in a way that the insert closure tab 219, a protruding die cut from the primary locking tab 222, engages with the corresponding shaped slot 216. This action prevents the locking tab 222 to lay flat along the back of the insert, shown in FIGS. 2, 3, 5 and 13A-B and allows the tab to interact with the corresponding locking notch 103 of the sleeve 100. FIG. 6B illustrates a view of an unglued insert 200A with two locking tabs. An additional locking tab 225 is positioned relatively to the locking notch 119 and release point 118 of the sleeve 100A shown in FIG. 13B. The additional locking tab 225, is formed by creating a corresponding shape on the back of the insert that folds over a score 227. Folding the tab back over the score keeps the tab from lying flat against the insert, allowing the tab to interact with the corresponding locking notch 119 of the sleeve 100A.

Figure 7:
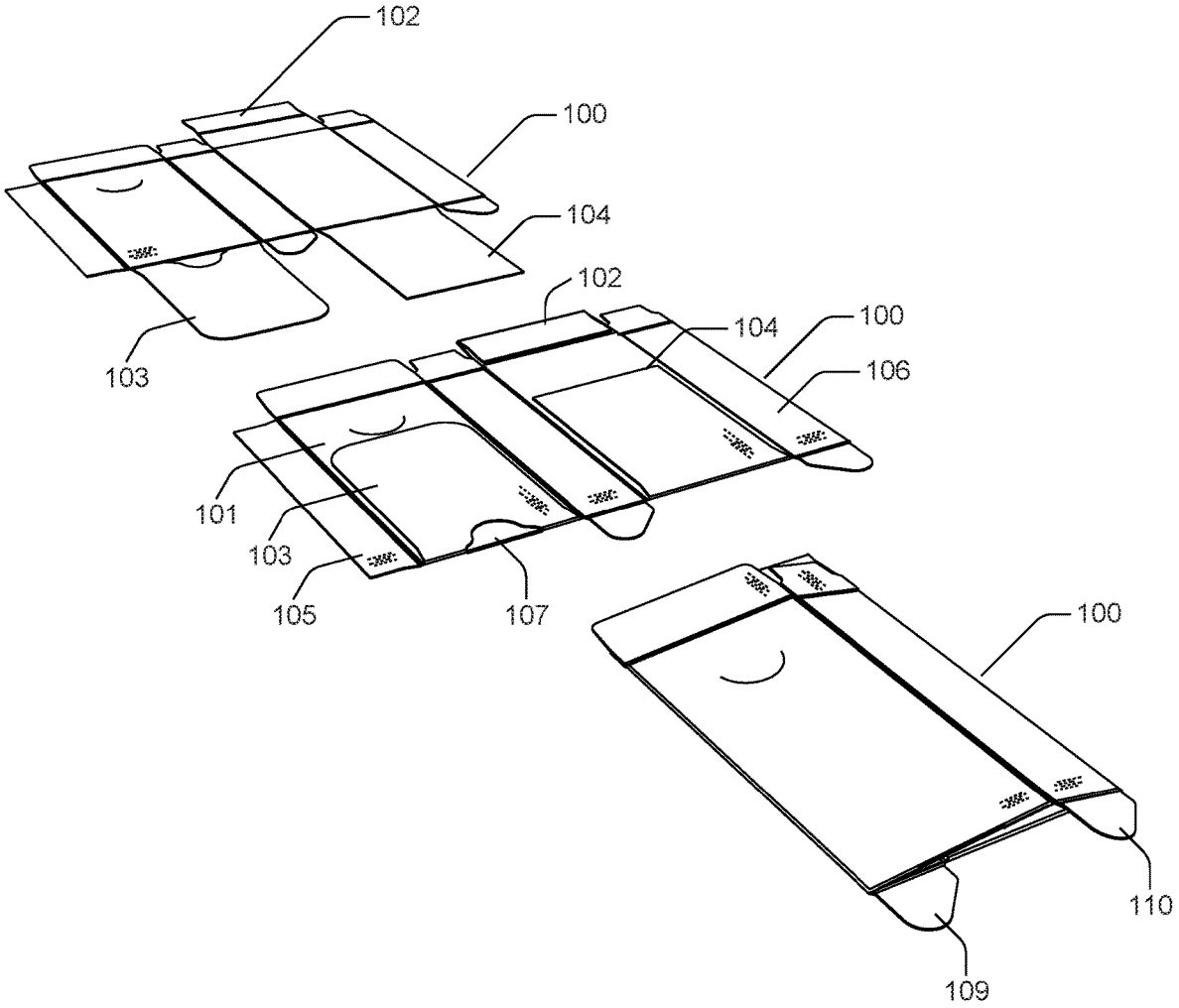
FIG. 7 illustrates a top perspective view of a series in progression of a reinforced sealed end sleeve with one locking feature shown unglued and partially assembled in accordance with an embodiment.
Figure 8:
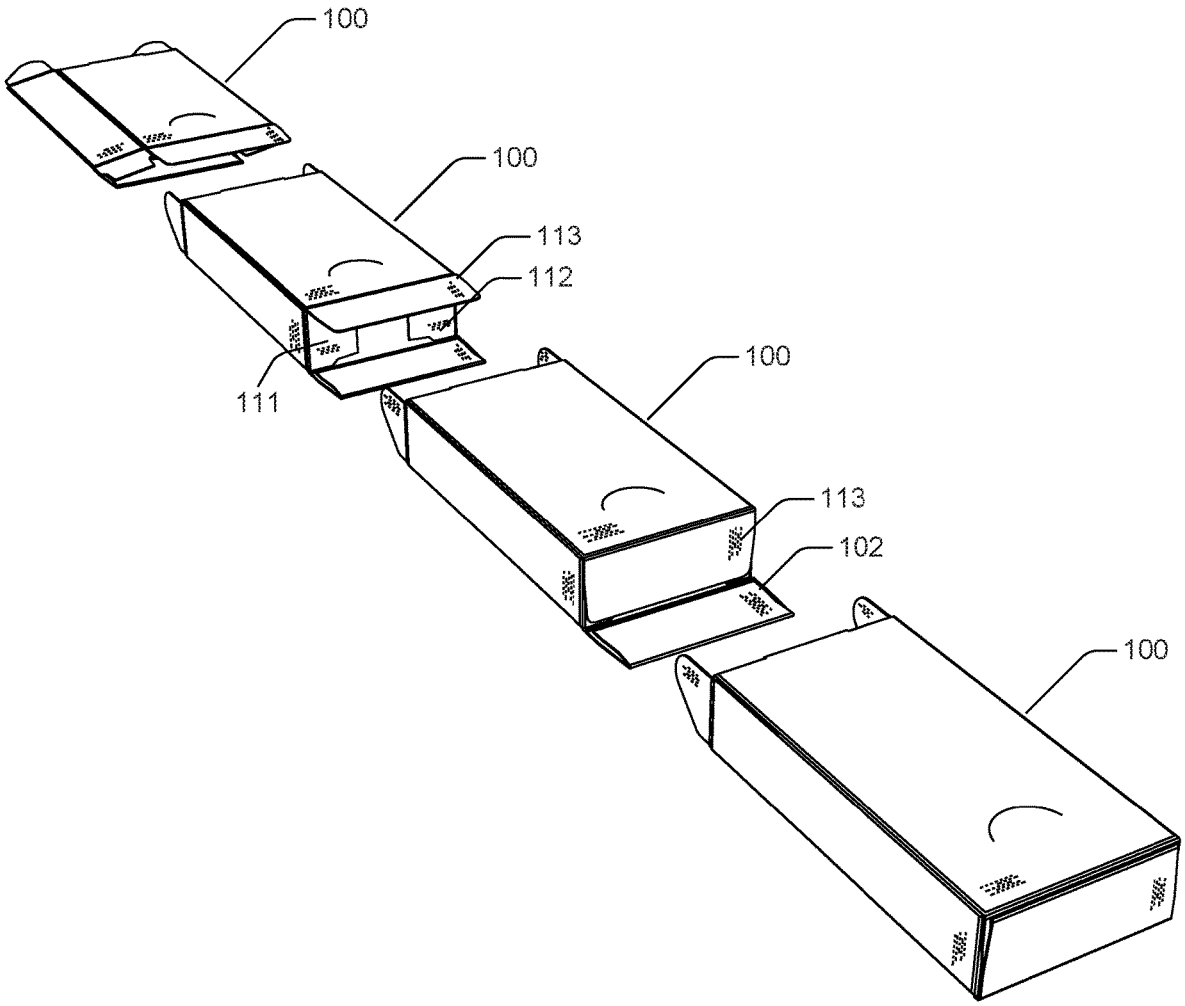
FIG. 8 illustrates a bottom perspective view of a series in progression of a glued reinforced sealed end sleeve with one locking feature shown partially assembled and fully assembled in accordance with an embodiment.
Figure 9A:
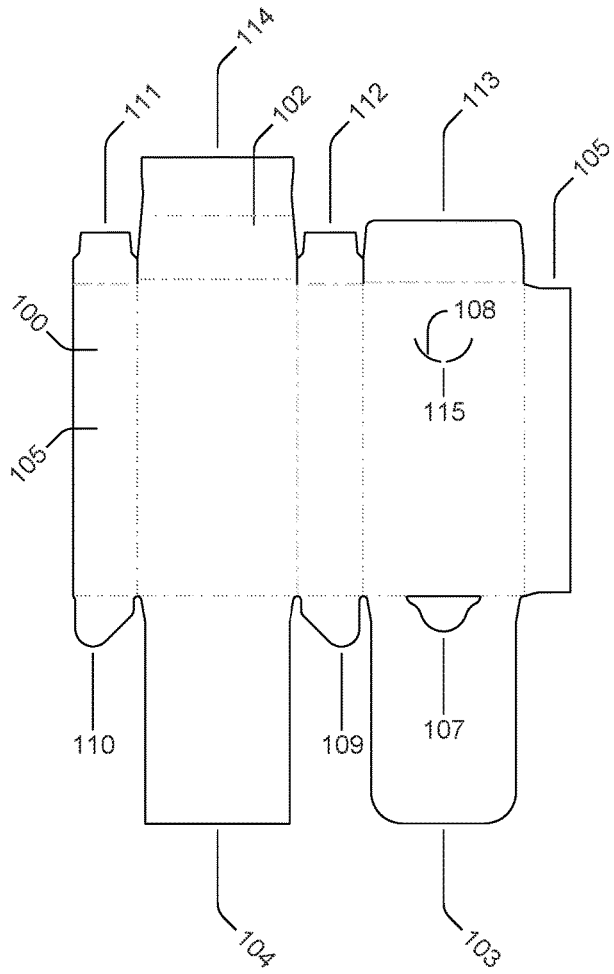
FIGS. 9A-B illustrate an unglued view of a reinforced sealed end sleeve with one locking feature (FIG. 9A) and with two locking features (FIG. 9B) with glue flaps on the side in accordance with embodiments.
Figure 9B:
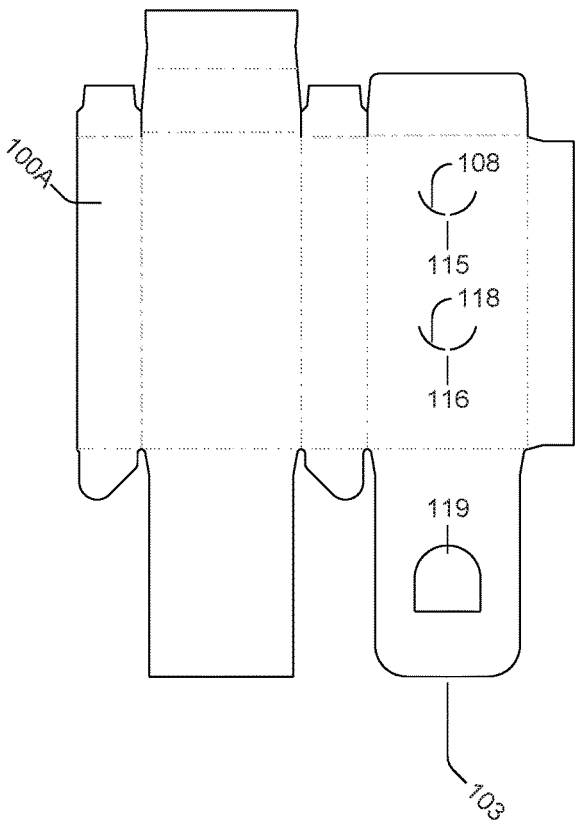
Figure 10:
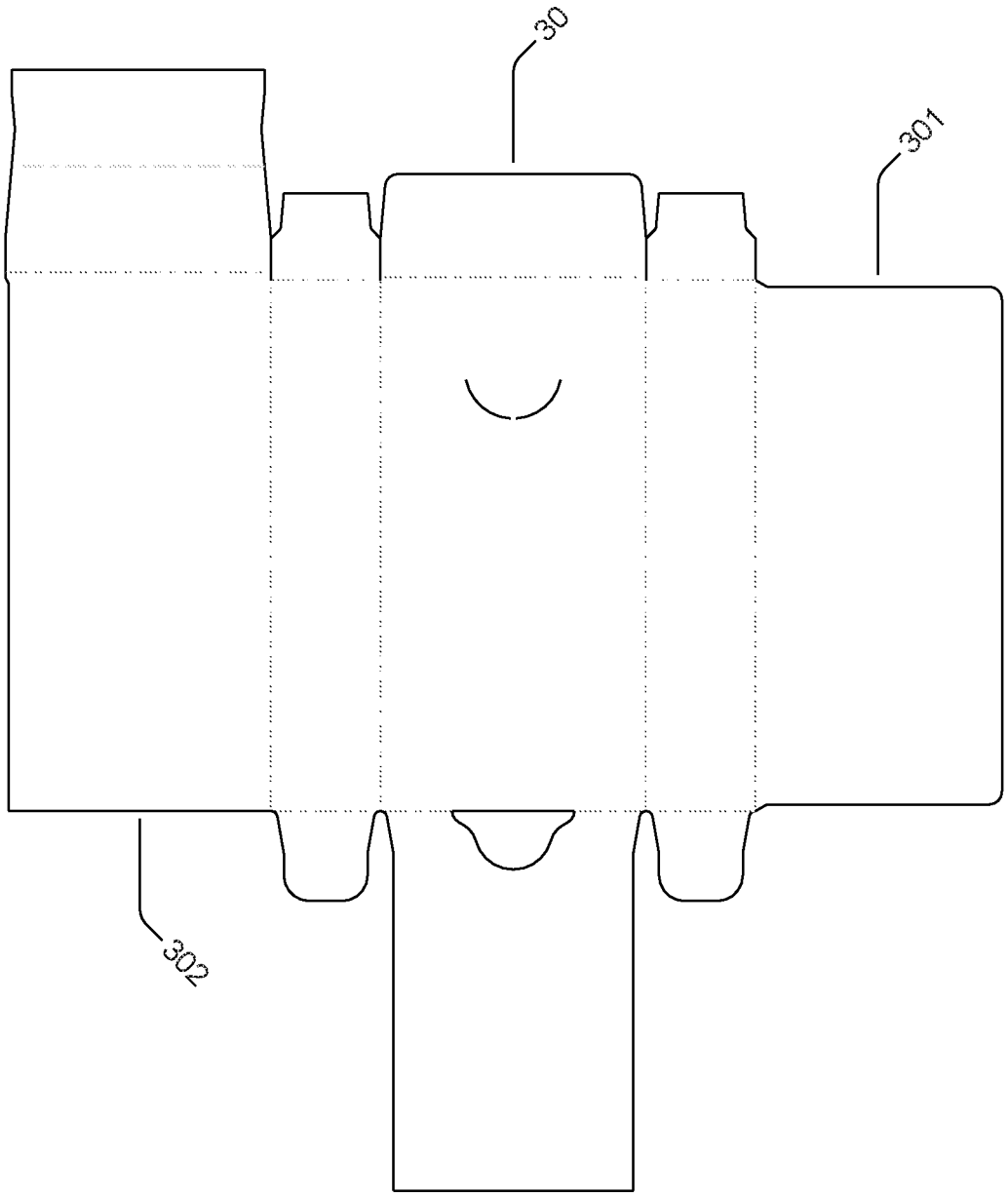
FIG. 10 illustrates an unglued view of a reinforced sealed end sleeve with one locking feature with a glue flap on the front in accordance with an embodiment.

FIGS. 7-9 illustrate perspective and flat views of a reinforced sealed end sleeve 100. The reinforcing flaps 102, 103 and 104 are folded and glued first. The folding over of material strengthens the sleeve by eliminating raw edges and delaminating of the material. It assists in preventing improper opening of the package. In addition, when the reinforcing back panel 103 is folded over, the locking notch 101 is also created that engages with the locking tab(s) 222 of the insert 200 (FIG. 13A). It also contains a prevention notch 107 for the prevention tab 211 (FIG. 13A) to lock into. The sleeve 100 is then conventionally folded and glued with a side glue flap 105 that adheres to the opposite side 106. The sleeve 100 can then be transferred to a separate piece of equipment. The sleeve 100 can be assembled, by hand or automated. As the sleeve moves through the equipment the minor flaps 111, 112 are automatically folded, followed by the back major panel 113. The front major panel 114 is then folded and glued on the back major panel. FIG. 9B illustrates a view of an unglued reinforced sealed end sleeve with two release points 108, 118 and two locking notches 101 (visible when glued), 119. The second release point 118 is positioned relatively to the sleeve 100A locking notches 101, 119 and the insert 200A secondary locking tab 225 (FIG. 13B). FIG. 10 illustrates a view of a sleeve 300 with a front glue flap 301 that adheres to the front panel 302. This version glues and functions similar to the version with the side glue flap.

Figure 11:
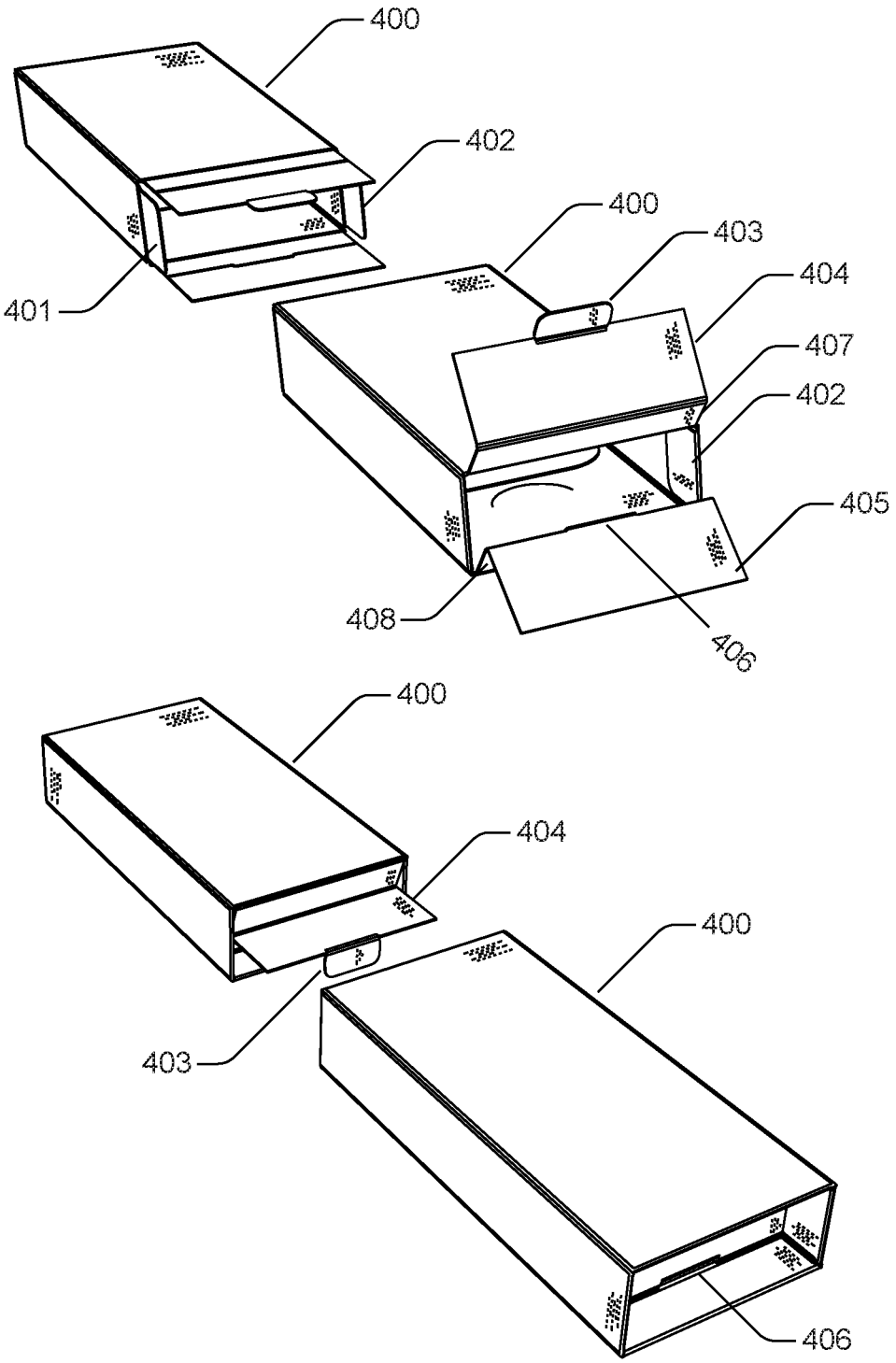
FIG. 11 illustrates a top perspective view of a series in progression for an assembled sleeve with a turn in recessed end closure in accordance with an embodiment.
Figure 12:
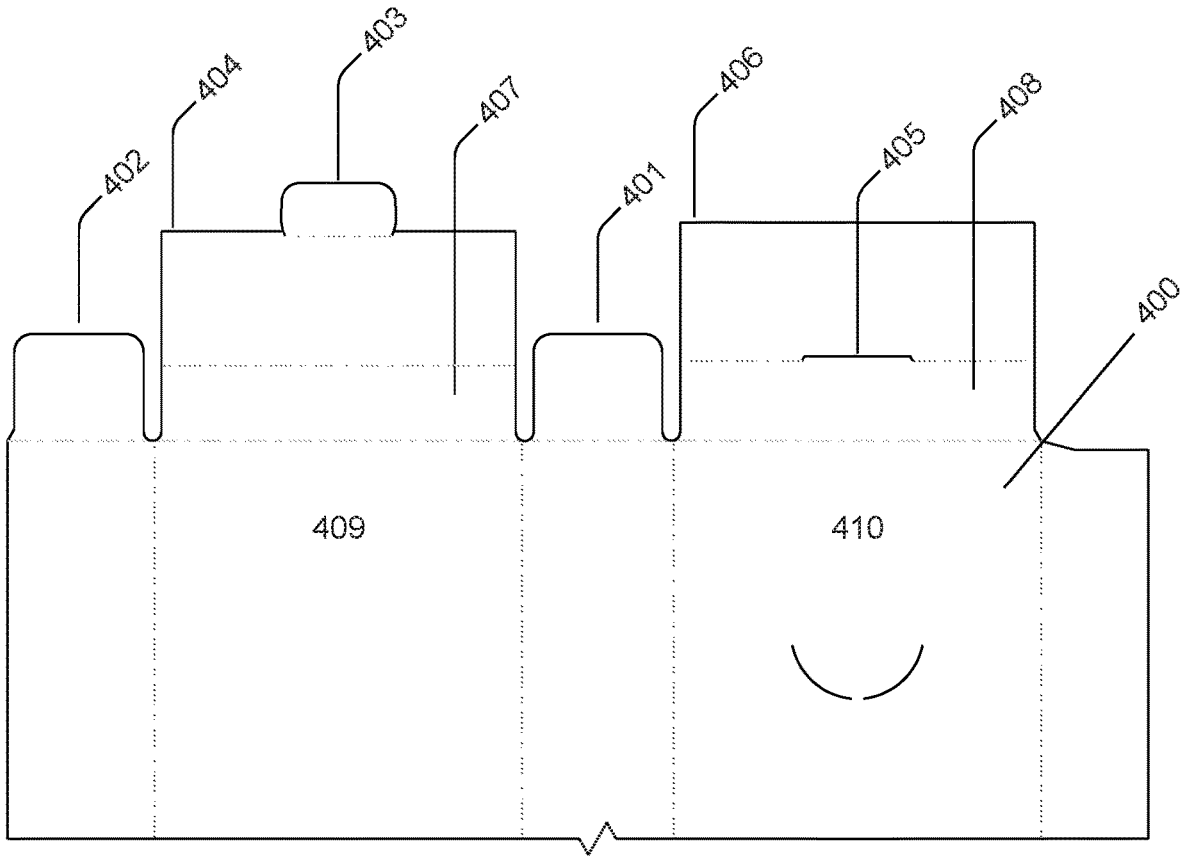
FIG. 12 illustrates a partial view of an unglued sleeve with a turn in recessed end closure in accordance with an embodiment.

FIG. 11 illustrates a front perspective view of an assembled sleeve with a sealed recessed end and FIG. 12 illustrates unassembled view of the sleeve with a turn-in recessed end closure in accordance with an embodiment. The minor flaps 401, 402 are folded down in the sleeve first. The sealed recessed end is created by extending panels 407, 408 from the front and back panels 409, 410 of the sleeve. The major panels 404, 405 extend from the extending panels. To close, the back major panel 406 is folded back as the extending panel 408 is folded forward. Then the front major panel 404 is folded back as the extending panel 407 is folded forward. A mailer lock 403 extends from the major panel 404 and folds into a slot 405 on the back major panel 406. The folding over of material strengthens the sleeve by eliminating raw edges and delaminating of the material. The depth of the recessed end prevents the closure from being accessed. This closure is an alternative manual closure that does not require gluing equipment to be sealed.

FIGS. 18-26, represent an embodiment of an open-ended sleeve 500, and a corresponding insert 600 that contain one locking feature that follows the locking premises described above. The insert 600 contains a locking tab 621 (FIGS. 20, 21, 25A-C, 26A-C and 27A) and prevention tab 609 (FIGS. 19, 21, 25A-C, 26A-C and 27B). In this embodiment the prevention tab 609 with a crease 625 prevents the insert 600 from being accessible through the incorrect end of the sleeve. The sleeve 500 contains the corresponding locking notch 515, prevention notch 514 formed by the cavity made by folded-over panel 501 and folded-over panel 504, and release tab point 511 (FIGS. 22, 24, 25A-C, 26A-C and 27A-B). As the insert 600 slides into the sleeve 500 from A to B, shown in FIGS. 25A-B the prevention tab 609 is held against the insert in a way that it does not interfere with the sleeve. Continue pushing the insert 600 until it reaches position B shown in FIG. 25B, known as the setting position. Prior to reaching position B the locking tab 621 with a crease 626 slides past the edge of the back-reinforcing panel 505 creating a sound as it is captured by the locking notch 515. The insert 600 is then be pushed from B to A until the prevention tab 609 engages the prevention notch 514 as shown in FIG. 25C. The package is now locked in the child resistant mode.

FIGS. 26A-C illustrate unlocking. First the insert 600 is pushed from A to B and placed in the setting position (FIG. 26B). Then pressure is applied to the release point 511 of the sleeve breaking the nick 513 (FIG. 24). Continue applying pressure to the release point while simultaneously pushing the insert from B to A with the opposite hand. Pressing in the release point 511, forces the locking tab 621 to lay flat against the insert 600 allowing it to avoid the locking notch 515 of the sleeve 500. The insert 600 will unlock and slide into a halted position shown in FIG. 17. The latching tabs 619, 624 on the insert engage with corresponding latching locking tabs 508, 509 on the sleeve. The latching tabs 619, 624 are formed on the insert 600 by folding extended material from the top panel of the insert (FIG. 21). The latching tabs 508, 509 on the sleeve 500 are formed by folding extended material from the side panels of the sleeve (FIG. 24).

FIGS. 19-21 illustrate perspective and flat views of an insert 600. The insert 600 is conventionally glued on standard gluing equipment and contains side panel glue flap 612 that adheres to the opposite side panel 602. The insert 600 is then manually assembled. After the insert 600 is erected the product cavity is formed by pressing down on the cavity panels 601, 603. As these panels fold down, the cavity feet 614, 615 fold-up. The bottom of the insert 600 can be folded next. The minor flaps 604, 607 are folded in first, followed by the bottom panel 605 and tuck 606. The remaining bottom major panel 611 folds on top of the folded panel 605 and continues to fold over the front of the insert 600. The prevention tab 609 is then folded back slightly on the score 625 in a way that allows the bottom insert closure tab 608 to engage with the insert closure slot 613. This prevents the insert 600 from opening and assists in keeping the prevention tab 609 from lying flat against the insert allowing it to engage with the sleeve prevention notch 514 (FIG. 27B). The top is then folded similar to the bottom (except no minor panels). The major panel 617 and the tuck 618 fold first. Then the remaining bottom major panel 623 folds on top of the folded panel 617 and continues to fold over the back of the insert 600 as shown in FIG. 20. The locking tab 621 is then folded back slightly on the score 626 in a way that allows the top insert closure tab 622 to engage with the insert closure slot 616. This prevents the insert 600 from opening and assists in keeping the locking tab 621 from lying flat against the insert allowing it to engage with the sleeve locking tab notch 515 (FIG. 27A). The latching tabs 619, 624 are then folded down and the insert can be inserted 600 into the sleeve 500.

FIGS. 22-24 illustrate perspective and flat views of the corresponding sleeve 500. The reinforcing flaps 501, 502, 503, 504, and 505 are folded and glued first. The folding over of material strengthens the sleeve by eliminating raw edges and delaminating of the material. It assists in preventing improper opening of the package. In addition, the folding and gluing of back-reinforcing panels 503, 505 leaves a void of material that forms the locking notch 515 and folding the front reinforcing panels 501, 504 leaves a void that forms the prevention notch 514. The sleeve 500 is then conventionally folded and glued on standard gluing equipment with a side glue flap 506 that adheres to the opposite side 507. After the sleeve 500 is glued, it can be manually setup. To do this, the latching tabs 508, 509 are folded in first. Then the reinforced glue tab 510 is folded and locked inside the sleeve 500. The tab should be pre-broken first at the score 512 (FIG. 23). Pre-breaking this tab and the shape of it assist in keep it against the glue flap and not interfering with the insert 600.

Although various embodiments have been depicted and described in detail herein, it will be apparent to those skilled in the relevant art that various modifications, additions, substitutions, and the like can be made without departing from the spirit of the disclosure and these are therefore considered to be within the scope of the disclosure as defined in the claims which follow.

What is claimed:

1. A locking package comprising:

a tray insert comprising top panel, bottom panel, front wall, back wall and two side walls, wherein at least one locking tab is comprised of a portion of the front wall folder over the bottom panel or a portion of the back wall folded over the top panel of the insert; and an outer sleeve comprising top panel, bottom panel, back wall, an opening opposite the back wall and two side walls, wherein at least one of the top or bottom panel comprises a dual panel which comprises an inner panel formed from an extended portion of a front or back of the top panel folded over and adhered to an inside of the top panel or a front or back of the bottom panel folded over and adhered to an inside of the bottom panel creating an edge comprising at least one locking notch and an outer panel comprising at least one locking tab release, wherein when the insert is fully slid into the sleeve the at least one locking tab, at least one locking notch and at least one locking tab release are positioned to lock and unlock the package.

2. The locking package according to claim 1, wherein the at least one locking tab, at least one locking tab release and at least one locking notch comprise a corresponding shape.

3. The locking package according to claim 1, further comprising a folded-over latching tab extending from each one of two sides of the back wall of the insert and a folded-over latching tab extending from each one of the two side walls at the opening end of the sleeve, the insert latching tabs corresponding to the sleeve latching tabs as the insert is pulled out of the sleeve preventing the insert from being completely pulled out from the sleeve.

4. The locking package according to claim 1, wherein the insert comprises a first locking tab corresponding to a first locking notch and a first locking tab release of the sleeve and a second locking tab corresponding to a second locking notch and a second locking tab release of the sleeve, wherein the corresponding locking tabs, locking notches and locking tab releases are positioned for simultaneous unlocking and locking coordination.

5. A locking package comprising:

a tray insert comprising top panel, bottom panel, front wall, back wall and two side walls, wherein at least one locking tab is comprised of a folded over portion of the top panel, bottom panel, front wall, back wall or two side walls of the insert; and an outer sleeve comprising top panel, bottom panel, back wall, an opening opposite the back wall and two side walls, wherein at least one panel or side wall comprises a dual panel or wall, respectively, wherein the dual panel or wall comprises an inner panel or wall comprising at least one locking notch and an outer panel or wall comprising at least one locking tab release, wherein when the insert is fully slid into the sleeve the at least one locking tab, at least one locking notch and at least one locking tab release are positioned to lock and unlock the package, further comprising a prevention tab comprised of a folded over portion of panel or wall of the insert and a prevention notch positioned at the open end of the sleeve comprised of two folded-over portions of the inner panel or wall forming a cavity in the inner panel or wall corresponding to the shape of the prevention tab to capture the prevention tab preventing the insert from being pulled out from the end of the sleeve opposite the open end of the sleeve.

6. A locking package comprising:

a tray insert comprising top panel, bottom panel, front wall, back wall and two side walls, wherein at least one locking tab and a prevention tab at one end of the tray are each comprised of a folded over portion of the top panel, bottom panel, front wall, back wall or two side walls of the insert; and an outer sleeve comprising top panel, bottom panel, two side walls and an opening at each end, wherein at least one panel or wall comprises an inner panel or wall comprising at least one locking notch and a prevention notch at one open end of the sleeve and an outer panel or wall comprising at least one locking tab release, wherein when the insert is fully slid into the sleeve the at least one locking tab, at least one locking notch and at least one locking tab release are positioned to lock and unlock the package, and wherein the prevention tab and prevention notch cooperate at the one open end of the sleeve preventing the sleeve from being pulled out from the other open end of the sleeve.

7. The locking package according to claim 6, wherein the at least one locking tab, at least one locking tab release and at least one locking notch comprise a corresponding shape.

8. The locking package according to claim 6, further comprising a folded-over latching tab extending from each one of the two side walls of the insert and a folded-over latching tab extending from each one of the two side walls at the opening end of the sleeve, the insert latching tabs corresponding to the sleeve latching tabs as the insert is pulled out of the sleeve preventing the insert from being completely pulled out from the sleeve.

9. The locking package according to claim 6, wherein the insert comprises a first locking tab corresponding to a first locking notch and a first locking tab release of the sleeve and a second locking tab corresponding to a second locking notch and a second locking tab release of the sleeve, wherein the corresponding locking tabs, locking notches and locking tab releases are positioned for simultaneous unlocking and locking coordination.

10. A method for unlocking a package comprising:

a tray insert comprising top panel, bottom panel, front wall, back wall and two side walls, wherein at least one locking tab is comprised of a portion of the front wall folder over the bottom panel or a portion of the back wall folded over the top panel of the insert; and an outer sleeve comprising top panel, bottom panel, back wall, an opening opposite the back wall and two side walls, wherein at least one of the top or bottom panel comprises a dual panel which comprises an inner panel formed from an extended portion of a front or back of the top panel folded over and adhered to an inside of the top panel or a front or back of the bottom panel folded over and adhered to an inside of the bottom panel creating an edge comprising at least one locking notch and an outer panel comprising at least one locking tab release, wherein when the insert is fully slid into the sleeve the at least one locking tab, at least one locking notch and at least one locking tab release are positioned to lock and unlock the package, the method comprising:

unlocking the tray insert from the outer sleeve by applying pressure to one or more release points of the outer sleeve to release the at least one locking tab of the insert from at least one corresponding locking notch of the sleeve, with one hand, and simultaneously gripping and pulling at an access point of the insert with the opposite hand.

11. The method according to claim 10, further comprising:

re-locking the package by sliding the tray insert into the outer sleeve, inserting the at least one locking tab of the tray insert into the at least one corresponding locking notch of the outer sleeve and continue sliding until a clicking sound is created.

* * * * *